US010829181B2

(12) United States Patent
Clark et al.

(10) Patent No.: US 10,829,181 B2
(45) Date of Patent: Nov. 10, 2020

(54) HYDROFOILING SAILBOAT

(71) Applicants: David Rittenhouse Clark, Warren, RI (US); Stephen H. Clark, Warren, RI (US)

(72) Inventors: David Rittenhouse Clark, Warren, RI (US); Stephen H. Clark, Warren, RI (US)

( * ) Notice: Subject to any disclaimer, the term of this patent is extended or adjusted under 35 U.S.C. 154(b) by 0 days.

(21) Appl. No.: 15/627,398

(22) Filed: Jun. 19, 2017

(65) Prior Publication Data

US 2017/0361902 A1 Dec. 21, 2017

Related U.S. Application Data

(60) Provisional application No. 62/351,919, filed on Jun. 18, 2016, provisional application No. 62/385,243, filed on Sep. 8, 2016.

(51) Int. Cl.
*B63B 35/00* (2020.01)
*B63B 1/28* (2006.01)
(Continued)

(52) U.S. Cl.
CPC ..... *B63B 1/28* (2013.01); *B63B 1/121* (2013.01); *B63B 1/242* (2013.01); *B63B 1/248* (2013.01);
(Continued)

(58) Field of Classification Search
CPC .... B63B 1/00; B63B 1/10; B63B 1/12; B63B 1/121; B63B 1/16; B63B 1/18;
(Continued)

(56) References Cited

U.S. PATENT DOCUMENTS 3,149,602 A 9/1964 Richard
3,354,857 A 11/1967 Hobday
(Continued)

FOREIGN PATENT DOCUMENTS

CN 102673729 A 9/2012
DE 202009017432 U1 5/2011
(Continued)

OTHER PUBLICATIONS

International Search Report and Written Opinion for PCT Application No. PCT/US2017/038195, dated Sep. 12, 2017, 13 pages.
(Continued)

*Primary Examiner* — Daniel V Venne
(74) *Attorney, Agent, or Firm* — Brake Hughes Bellermann LLP

(57) ABSTRACT

A multihull sailing vessel includes at least two buoyant hulls extending along their longitudinal axes, with the hulls being connected to each other and a first hydrofoil connected to the hulls and oriented transverse to the hulls. The first hydrofoil is movably coupled to the hulls between a first position above a resting waterline of the hulls and a second position below a lowest extent of the hulls. When the first hydrofoil is in the second position, a configuration of the first hydrofoil is adjustable to vary an amount of lifting force generated by the first hydrofoil when the hulls move forward through water when the first hydrofoil is in the second position.

38 Claims, 17 Drawing Sheets

(51) Int. Cl.

| | |
|---|---|
| ***B63B 1/24*** | (2020.01) |
| ***B63B 1/26*** | (2006.01) |
| ***B63B 1/30*** | (2006.01) |
| ***B63B 1/12*** | (2006.01) |
| ***B63B 15/00*** | (2006.01) |
| ***B63H 9/10*** | (2006.01) |
| *B63H 9/08* | (2006.01) |

(52) U.S. Cl.
CPC ..... *B63B 1/26* (2013.01); *B63B 1/286* (2013.01); *B63B 1/30* (2013.01); *B63B 15/0083* (2013.01); *B63H 9/10* (2013.01); *B63B 35/00* (2013.01); *B63B 2001/123* (2013.01); *B63H 2009/082* (2013.01)

(58) Field of Classification Search
CPC .... B63B 1/20; B63B 1/22; B63B 1/24; B63B 1/242; B63B 1/248; B63B 1/28; B63B 1/285; B63B 1/286; B63B 1/30; B63B 15/0083; B63B 2001/10; B63B 2001/12; B63B 2001/121; B63B 2001/00; B63B 2001/16; B63B 2001/18; B63B 2001/20; B63B 2001/203; B63B 2001/204; B63B 2001/205; B63B 2001/206; B63B 2001/24; B63B 2001/28; B63B 2001/281; B63B 2015/0016; B63B 2015/005; B63B 2015/083; B63B 35/00; B63H 9/00; B63H 9/04; B63H 9/06; B63H 9/08; B63H 9/10; B63H 2009/00; B63H 2009/04; B63H 2009/06; B63H 2009/0685; B63H 2009/08; B63H 2009/082
USPC ..... 114/39.21, 39.24, 39.26, 39.32
See application file for complete search history.

(56) References Cited

U.S. PATENT DOCUMENTS

| | | | | |
|---|---|---|---|---|
| 3,802,366 | A * | 4/1974 | Mankawich | B63B 1/28 114/102.21 |
| RE28,615 | E * | 11/1975 | Keiper | B63B 1/30 114/281 |
| 3,949,695 | A * | 4/1976 | Pless | B63B 1/28 114/274 |
| 5,136,961 | A * | 8/1992 | Follett | B63B 1/248 114/274 |
| 7,743,720 | B1 | 6/2010 | Salani | |
| 2003/0000441 | A1 | 1/2003 | Estabrooks | |
| 2007/0157864 | A1 | 7/2007 | Aldin et al. | |
| 2013/0228111 | A1 | 9/2013 | Stephinson et al. | |

FOREIGN PATENT DOCUMENTS

| | | | |
|---|---|---|---|
| GB | 2464768 | A | 5/2010 |
| JP | 2004268813 | A | 9/2004 |

OTHER PUBLICATIONS

International Preliminary Report on Patentability for International Application No. PCT/US2017/038195, dated Dec. 27, 2018, 12 pages.
Communication pursuant to Rule 164(1) EPC with partial supplementary search report for European Application No. 17814274.1, dated Dec. 11, 2019, 17 pages.
Extended European Search Report for European Application No. 17814274.1, dated Mar. 18, 2020, 13 pages.

* cited by examiner

HYDROFOILING SAILBOAT

CROSS-REFERENCE TO RELATED APPLICATIONS

This application is a non-provisional of, and claims priority to U.S. Provisional Patent Application No. 62/351,919, filed Jun. 18, 2016, titled "User Friendly Hydrofoiling Sailboat" and to U.S. Provisional Patent Application No. 62/385,243, filed Sep. 8, 2016, titled "Hydrofoiling Sailboat," both of which are incorporated by reference in their entirety.

TECHNICAL FIELD

This description relates to hydrofoiling sailboats.

BACKGROUND

Hydrofoiling sailboats often are complex, fragile, and difficult to control. Lifting foils of a hydrofiling sailboat can be awkward and cumbersome and prone to breakage, for example, while the sailboat is operated in shallow water or while the sailboat is maneuvered on land. In addition, the depth at which a hydrofoil must be inserted into the water to allow the sailboat to be lifted out of the water by the hydrofoil can make sailing the hydrofoil sailboat in shallow water (e.g., less than 3 feet of depth) prohibitive.

SUMMARY

According to an example, a multihull sailing vessel includes at least two buoyant hulls extending along their longitudinal axes, with the hulls being connected to each other and a first hydrofoil connected to the hulls and oriented transverse to the hulls. The first hydrofoil is movably coupled to the hulls between a first position above a resting waterline of the hulls and a second position below a lowest extent of the hulls. When the first hydrofoil is in the second position, a configuration of the first hydrofoil is adjustable to vary an amount of lifting force generated by the first hydrofoil when the hulls move forward through water when the first hydrofoil is in the second position.

Implementations can include one or more of the following features. The following features can be included individually or in any combination with each other. For example, the hulls can be connected to each other by a beam member that extends in a direction transverse to the hulls, with the beam member having ends that are attached, respectively, to the different hulls. The configuration of the first hydrofoil can be adjustable to vary a cross-sectional shape of the first hydrofoil. The cross-sectional shape of the first hydrofoil can be varied by changing an angle of a flap element at a trailing edge of the first hydrofoil with respect to a fixed element of the first hydrofoil, which is forward of the flap element. The configuration of the first hydrofoil further can be adjustable to vary an angle of attack of the first hydrofoil with respect to the surface of the water. The configuration of the first hydrofoil can be adjustable automatically in response to a height of the hulls above the waterline of the hulls.

A trunk can be connected to the hulls, and the trunk can include a vertical sleeve, and a daggerboard attached to the first hydrofoil can be movably mounted in the vertical sleeve, and first hydrofoil can be movable between the first position and the second position in response to vertical movement of the daggerboard within the sleeve. The sailing vessel can include a rudder, and a lateral surface area of the rudder below the waterline can be greater than a lateral surface area of the daggerboard below the waterline when the daggerboard is lowered to its downmost operational position within the vertical sleeve.

The sailing vessel of claim 1 can include a rudder, and a second hydrofoil can be attached to the rudder and can extend transversely from the rudder with respect to the longitudinal axes of the hulls.

The sailing vessel can include a mast and the first hydrofoil can be mounted forward of the mast. When the first hydrofoil is in the second position the first hydrofoil can be configured to generate a lifting force when the hulls move forward through water at a speed of less than seven meters per second, where the generated lifting force, when combined with lifting forces of other hydrofoils of sailing vessel, is sufficient to lift both hulls above the surface of the water. When the first hydrofoil is in the second position the first hydrofoil can be configured to generate a lifting force of greater than 200 pounds when the hulls move forward through water at a speed of seven meters per second.

In another general aspect, a sailing vessel includes a hull, a mast, and first and second spreader members coupled to the mast and extending away from the mast. A first jumper stay is coupled to the mast at a first location below the first spreader member and at a second location above the first spreader member and is sprung away from the mast by an outboard end of the first spreader member, with the outboard end of the first spreader member being located forward of the mast. A second jumper stay is coupled to the mast at a third location below the second spreader member and at a fourth location above the second spreader member and is sprung away from the mast by an outboard end of the second spreader member, with the outboard end of the second spreader member being located forward of the mast. The sailing vessel further includes a wishbone boom having a first boom member having a first end attached to the first spreader member and a second end located aft of the mast a second boom member having a first end attached to the second spreader member and a second end located aft of the mast. The second ends of the first and second boom members are coupled to each other and are configured to secure an aft portion of a sail when the sail is attached to the mast.

Implementations can include one or more of the following features. The following features can be included individually or in any combination with each other. For example, a tension of the first jumper stay and a tension of the second jumper stay can be greater than 10 pounds during operation of the sailing vessel. The tension of the first and second jumper stays can be adjustable by an operator of the sailing vessel. The second location and the fourth location can be on the mast between 30% and 70% of the way from a base of the mast to the tip of the mast. The first location and the third location can be located on the mast between 0% and 20% of the way from a base of the mast to a tip of the mast. The second location in the fourth location can be located on the mast between 50% and 75% of the way from a base of the mast and a tip of the mast. The first spreader member and the second spreader member can be rigidly attached to each other.

A topping lift stay can be coupled to the second ends of the first and second boom members and also can be coupled to a tip of the mast, and a downhaul stay can be coupled to the second ends of the first and second boom members and also can be coupled to a base of the mast. A tension of the topping lift stay and a tension of the downhaul stay can both greater than 10 pounds during operation of the sailing vessel.

The tension of the downhaul stay is adjustable by an operator of the sailing vessel.

DETAILED DESCRIPTION

As described herein, a sailing vessel can be fitted with at least one lift-generating hydrofoil, oriented in such a fashion as to be capable of both various forms of flight orientations that provide a lifting force to the sailing vessel in a direction perpendicular to the surface of the water in which the sailing vessel operates (e.g., to provide sufficient lifting force to lift the sailing vessel and its human crew above the surface of the water) and also to be capable of a variety of easy launching orientations and non-flight sailing orientations. The at least one lift-generating hydrofoil can be moved by an operator of the sailing vessel between the "flight" orientations and the non-hydrofoiling sailing orientations.

Figure 1:
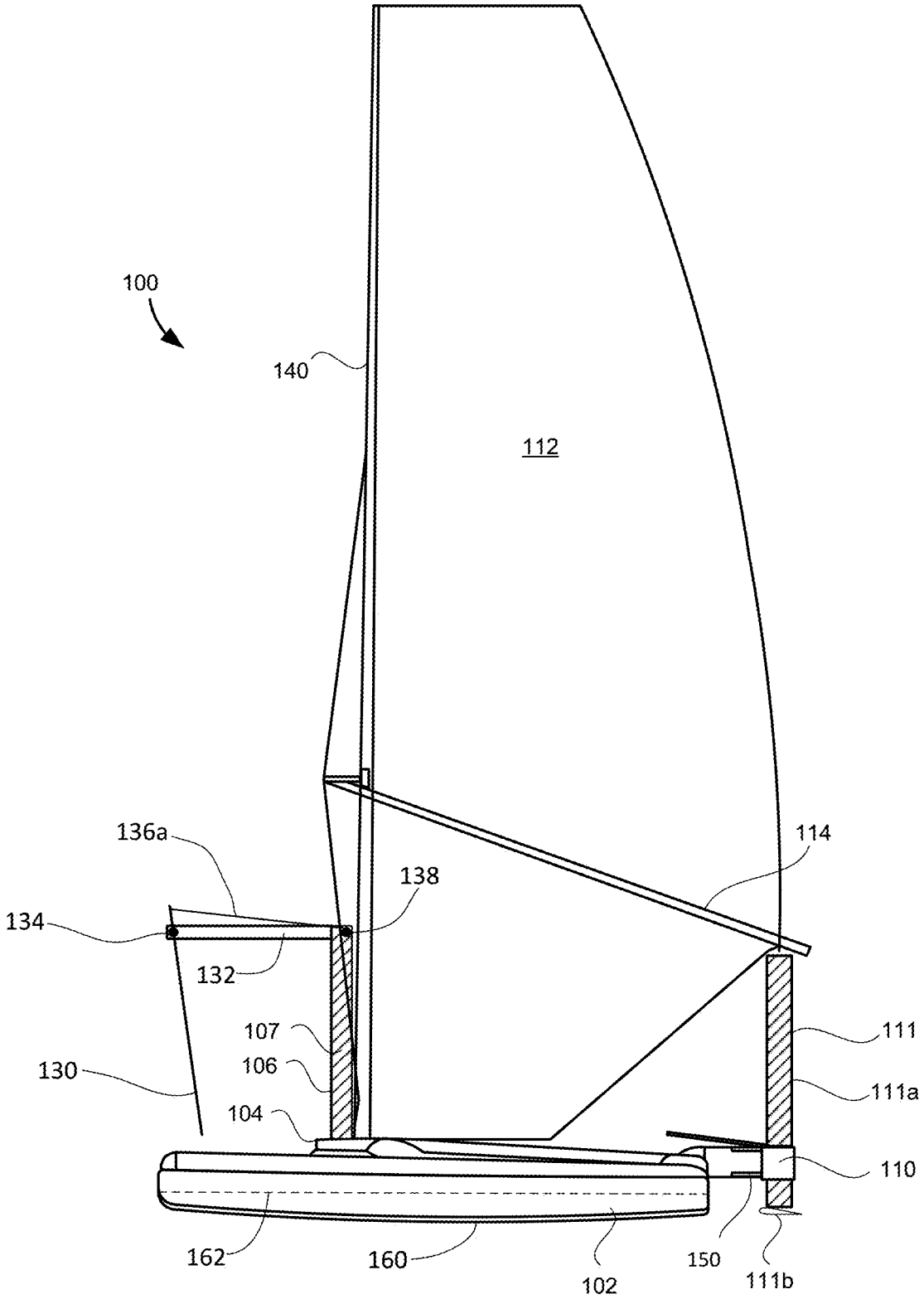
FIG. 1 is a side view of a hydrofoiling sailing vessel.

FIG. 1 is schematic side view of a sailing vessel 100. As shown in FIG. 1, the sailing vessel 100 can include at least one hull 102. For example, when the sailing vessel 100 is a multihull sailing vessel, the sailing vessel 100 includes at least two hulls that extend along their longitudinal axes and that are connected to each other. For example, the hulls 102 of the sailing vessel 100 can extend along their longitudinal axes in directions that are substantially parallel. One hull 102 of a multi-hull sailing vessel 100 is shown in FIG. 1, while a second hull is hidden from view behind the hull 102 in the schematic side view of FIG. 1. The hulls 102 of the sailing vessel 100 can be fixedly connected to each other when the sailing vessel 100 is operated in the water. In one implementation, the hulls 102 can be attached to each other by one or more transverse beams that extend in a direction perpendicular to the longitudinal axes of the hulls and that are attached at or near their two ends, respectively, to the two different hulls. A deck structure, upon which human crew of the sailing vessel 100 can sit or stand, can be supported between the hulls and/or by the transverse beams that connect the hulls.

The sailing vessel 100 can include a trunk structure 104 to which a main hydrofoil structure 106 is secured while sailing the sailing vessel 100. The trunk structure 104 can be located between the outboard hulls of the vessel 104. For example, for a catamaran version of the sailing vessel, the trunk structure 104 can be located inboard of both hulls 102 of the sailing vessel 100, and for a trimaran version of the sailing vessel, the trunk structure 104 can be located inboard of the outer amas of the sailing vessel 104.

The main hydrofoil structure 106 can include a vertical member 107 (e.g., a daggerboard) and a hydrofoil 108 (not shown in FIG. 1) that extends in a direction transverse to the longitudinal axes of the hulls 102 and that can be configured to provide, when vessel 100 moves forward through the water with the hydrofoil in the water, a lifting force in a direction upward toward the surface of the water. The trunk structure 104 also can support a mast 140 of the sailing vessel 100. For example, a base of the mast 140 can be secured in place by the trunk structure 104. The base of the mast 140 can be secured in place in a position that is aft of the location of the main hydrofoil structure 106 and that is aft of the hydrofoil 108.

The sailing vessel can include at least one rudder 111 that is connected to the hulls 102 of the sailing vessel. For example, in some implementations, the rudder 111 can be secured in a cassette structure 110 that includes two opposing surfaces between which the rudder can move vertically up and down, but which can be tightened together to secure the rudder 111 in place.

In some implementations, the cassette structure 110 can be connected to the hulls 102 by a gantry structure 150. For example, the gantry structure can be secured to both the left and the right hulls 102, with the rudder 111 being located approximately midway between the hulls or between vertical planes in which the left and right hulls 102 are located. In another implementation, the sailing vessel 100 can include multiple rudders 110, with separate rudders 111 being connected to each of the right and left hulls 102 of the sailing vessel 100.

In some implementations the sailing vessel 102 can have right and left hulls 102 that are separated from each other laterally in a direction perpendicular to the fore-and-aft direction of the vessel (i.e., the direction of the longitudinal axes of the hulls), with the trunk structure 104 being located between the right and left hulls and/or between vertical planes in which the hulls are located. The right and left hulls 102 can provide for safe navigation when the hulls 102 of the sailing vessel 100 are not flying above the surface of the water. The mast 140 can support a sail 112 that provides wind-powered propulsion for the sailing vessel 100. The mast 140 can be connected to the hulls, for example, by being secured to the trunk structure 104 that is connected to the hulls, for example, by one or more beams that connect the hulls, and the mast 140 can be located aft of the main hydrofoil structure 106 and the hydrofoil 108 and can be located forward of the rudder 111.

The main hydrofoil structure 106 can be located forward of the mast 140 and the sail 112, and the rudder 111 can be fully clear of the sail and boom 114, even when the rudder is in a raised position with the rudder hydrofoil 111*b* above the waterline 162 of the hulls 102.

The main hydrofoil structure 106 can include a vertical member 107 that provides a lateral force on the sailing vessel 100 during operation of the vessel when the sail 112 is oriented relative to the wind, such that the wind provides a lateral force on the sail 112 and, in turn, on the vessel 100. As a consequence of the lateral force of the wind on the sail 112, a lateral force and a direction opposite to the force provided by the wind can be provided by the vertical member 107 when the vertical member is deployed in the water. In addition to the lateral force provided by the vertical member 107 that opposes the lateral force provided by the wind on the sail 112, the hull(s) 102 also can provide a lateral force in a direction opposite to that of the lateral force provided by the wind on the sail 112.

In addition, the rudder 111 can include a vertical member 111*a* that provides a lateral force on the sailing vessel 100 during operation and a second hydrofoil member 111*b* that can provide a vertical force on the sailing vessel 100 while the vessel is moving through the water. The vertical members 107, 111*a* of the main hydrofoil structure 106 and the rudder 111, respectively, can be connected to the hulls 102, such that they can be moved vertically up and down with respect to the surface of the water when the vessel is floating in the water, so that the horizontal members 108, 111*b* can be moved from positions that are fully out of the water when the sailing vessel 100 is afloat in the water to fully in the water the boat when the sailing vessel 100 is afloat in the water. For example, the vertical member 107 can pass through a vertical sleeve in the trunk structure 104 that is connected to the hulls 102 (e.g., that is integrated with a beam that is attached to the hulls). The dimensions of the vertical sleeve can closely match the cross-sectional dimensions of the vertical member (e.g., daggerboard) 107, so that the vertical member is secured fore-and-aft and side-to-side within the sleeve but also can move up and down within the sleeve. With the trunk structure 104 being located between the outboard hulls of the vessel 100 the vertical member 107 of the hydrofoil structure 106, which passes through the sleeve, can also be located between the outer hulls 102 of the sailing vessel 100.

The mast 140 can be behind the hydrofoil structure 106. For example, the location at which the mast 140 is supported by the sailing vessel 108 can be behind the sleeve through which the vertical member 107 passes. Similarly, the rudder 111 can be pass vertically through a cassette 110 structure that is connected by a gantry structure 150 to the hulls 102.

The side view of the sailing vessel 100 in FIG. 1 shows a "launching state" of the sailing vessel 100, that can be used when the sailing vessel 100 is on land (e.g., when the sailing vessel 100 is carried by a dolly or trailer) or when the sailing vessel 100 is first placed into the water. In this state, both the vertical member 107 of the hydrofoil structure 106 and the rudder 111 are withdrawn vertically through their respective mounting structures 104, 110, such that their attached foils (i.e., main hydrofoil 108 rudder hydrofoil 111*b*) are above the bottom or the boat, for example, when the foils are above a plane parallel to a waterline 162 of the vessel, where the plane includes the point(s) corresponding to the lowest extent 160 of the hulls 102 in the water when the sailing vessel is floating, unloaded and not moving, in the water.

In the launching state, both the vertical member 107 of the hydrofoil structure 106 and the rudder 111 can be withdrawn vertically through their respective mounting structures 104, 110, such that their attached foils (i.e., main hydrofoil 108 rudder hydrofoil 111*b*) are also above a waterline 162 of the hulls 102 at which the sailing vessel floats when unloaded and not moving in the water. In this launching state configuration, with the hydrofoils are retracted above the bottom extent 160 of the sailing vessel 100, the hydrofoils 108, 111*b* are protected from accidental damage due to the running aground while sailing the boat in water, from dropping the boat on land, etc.

Figure 2:
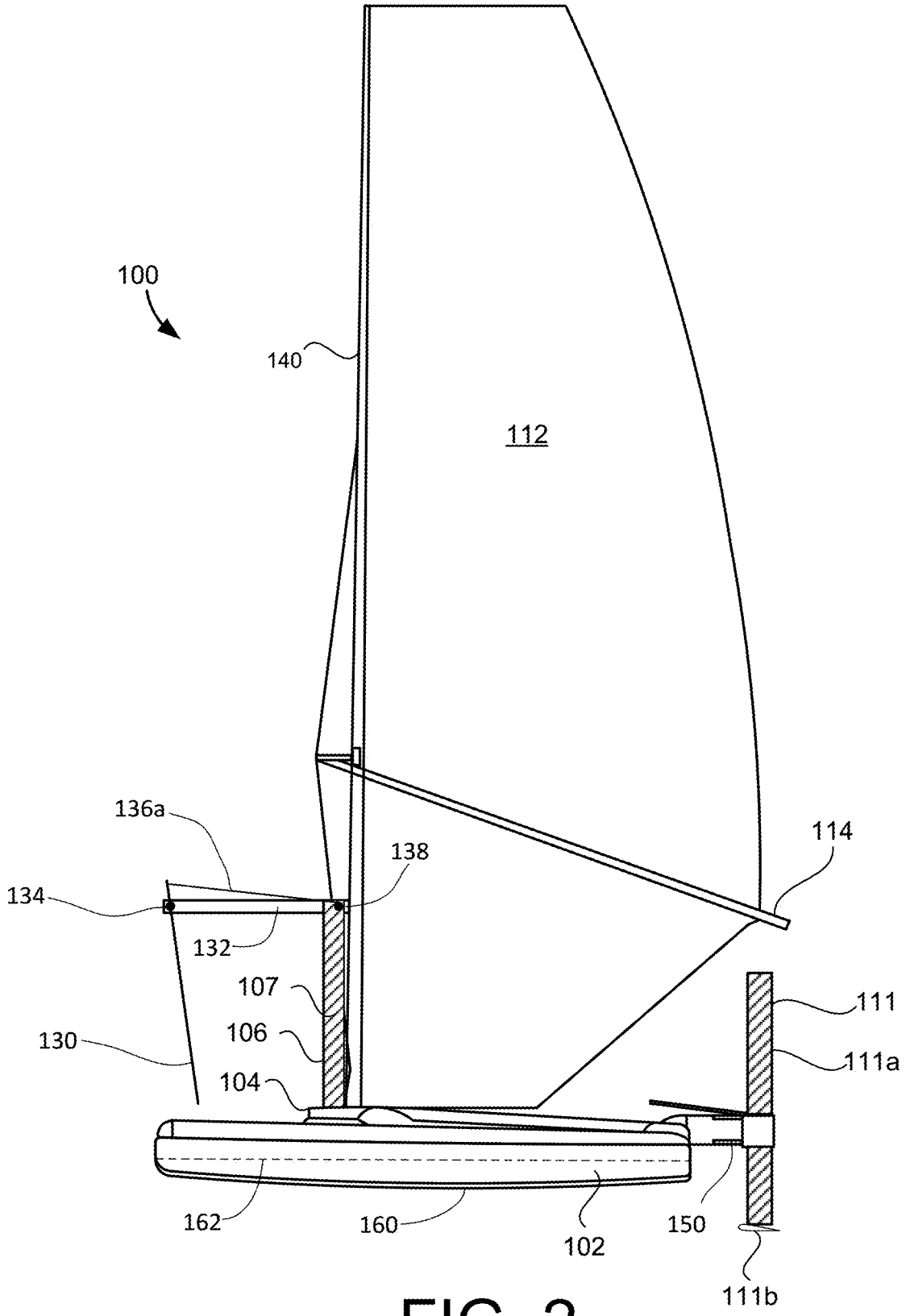
FIG. 2 is another side view of the hydrofoiling sailing vessel of FIG. 1.

FIG. 2 shows a basic "non-foiling" navigation state of the sailing vessel 100 in which the hydrofoil 108 of the main hydrofoil structure is not deployed into the water, but the second hydrofoiling member 111*b* and a non-zero percentage of the vertical member 111*a* of the rudder 111 are deployed below the waterline 162 of the sailing vessel 100 into the water, thus enabling steering of the vessel 100. In this "non-foiling" navigation state of the sailing vessel 100, the hull(s) 102 can generate sufficient lateral force on the sailing vessel without the daggerboard 107 being deployed into the water to enable basic navigation of the sailing vessel 100 under sail.

Figure 3:
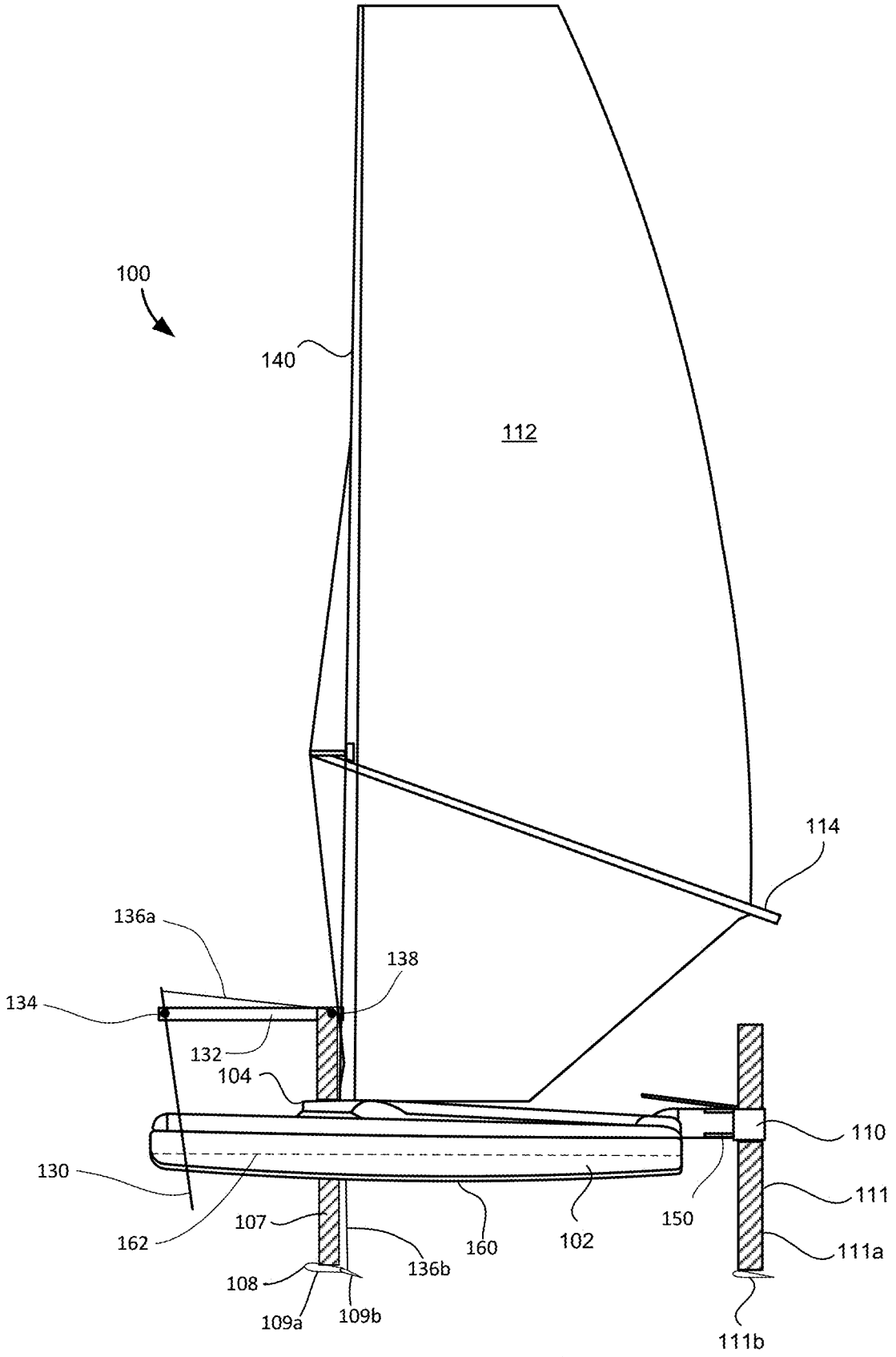
FIG. 3 is another side view of the hydrofoiling sailing vessel of FIG. 1.

FIG. 3. shows a third state of the sailing vessel 100 in which a portion of the vertical member 107 of the main hydrofoil structure 106 and a portion of the vertical member 111*a* of the rudder 111 are both partially deployed with beneath the waterline 162 of the sailing vessel 100. In this state, the main hydrofoil 108 and the second hydrofoil 111*b* can be capable of generating sufficient vertical force on the sailing vessel to lift the hull(s) out of the water during operation of the vessel 100, without committing the hydrofoils 108, 111*b* to their deepest depths below the waterline. This results in a reduction in drag presented by the vertical member 107 and by the rudder 111, compared to when the vertical member and the rudder are deployed to their most downward positions in the trunk 104 and the cassette 110, respectively, and thus enables faster speeds and a quicker transitions, as compared with having the hydrofoils deployed to their maximum depths, from sailing the vessel 100 with the hulls 102 in the water to generating sufficient lifting force such that "takeoff" to sailing with the hulls above the surface of the water occurs. Additionally, it permits operators of the sailing vessel 100 to experience the lifting force of the foils without the vessel being lifted out of the water or above a maximum threshold height that is lower than the full height of which the vessel is capable with the foils deployed to their maximum depths.

Figure 4A:
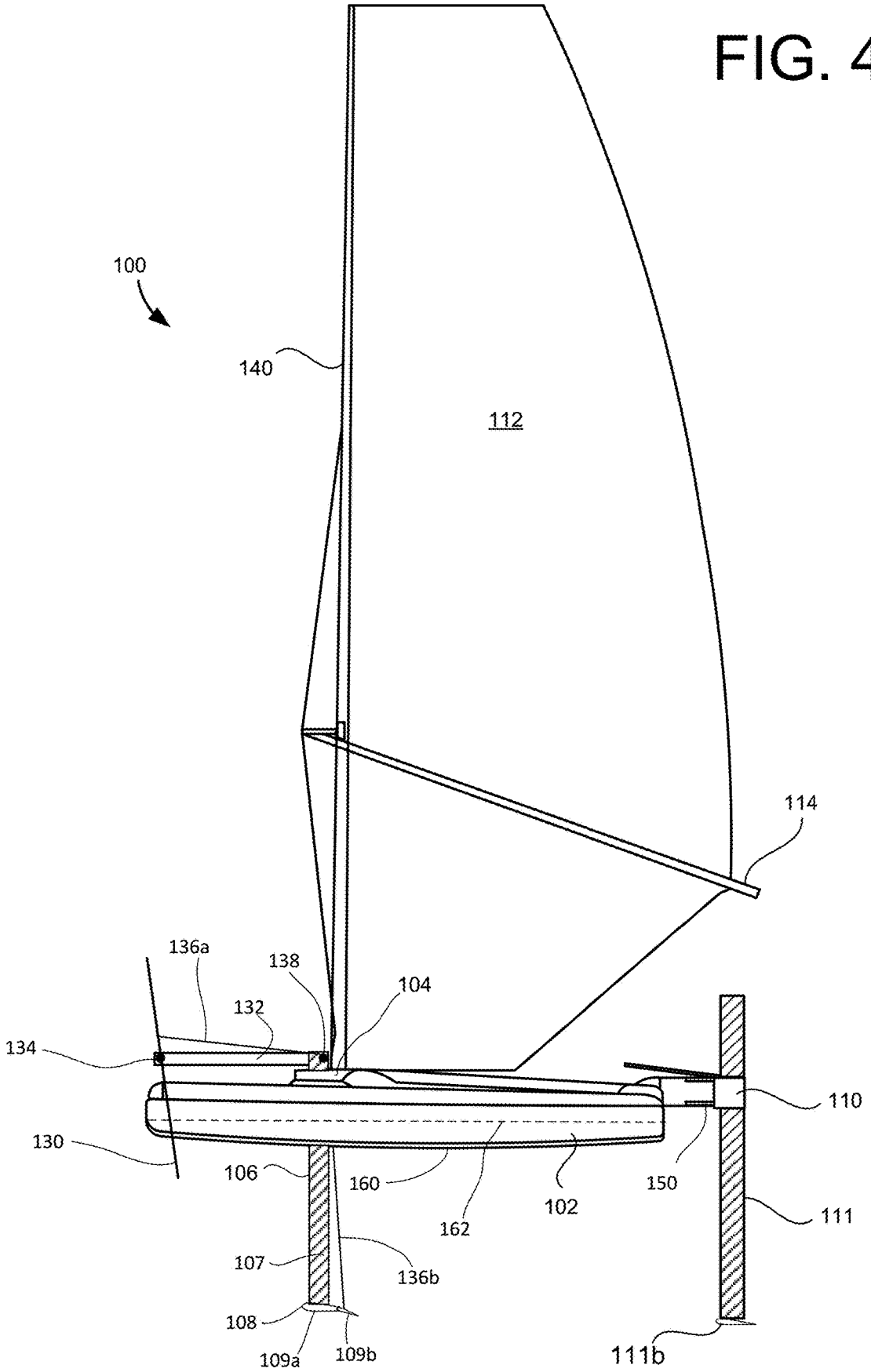
FIG. 4A is another side view of the hydrofoiling sailing vessel of FIG. 1.

FIG. 4A shows a fourth state of the hydrofoils 106, 111 of the sailing vessel 100 in which both hydrofoils 106, 111 are deployed to their maximum depths below the waterline 162, enabling the vessel 100 to fly at a height roughly equal to the extension of the foils downwards below the water surface. As shown in FIG. 4A, a wand 130 has been partially withdrawn upward through a pivot point 134, as compared to the position of the wand 130 shown in FIG. 3, so that approximately similar amounts of the wand are submerged in, or strike, the water in both the positions shown in FIGS. 3 and 4. The pivot point 134 can include a hollow sleeve through which the wand 130 can slide to allow this movement of positions of the wand, and the wand 130 can be held in place by friction between the wand and the sleeve when in its different positions.

As described herein, the main hydrofoil structure 106 includes a hydrofoil member 108 that is oriented transverse to the longitudinal axes of the hulls. The hydrofoil member 108 can extend outwardly from both sides of the vertical member 107. In some cases, the hydrofoil member 108 can be symmetric about a plane of the vertical member 107. In some cases, the hydrofoil member 108 can be located entirely between the vertical planes that contain the outer hulls 102 of the vessel 100.

Figure 4B:
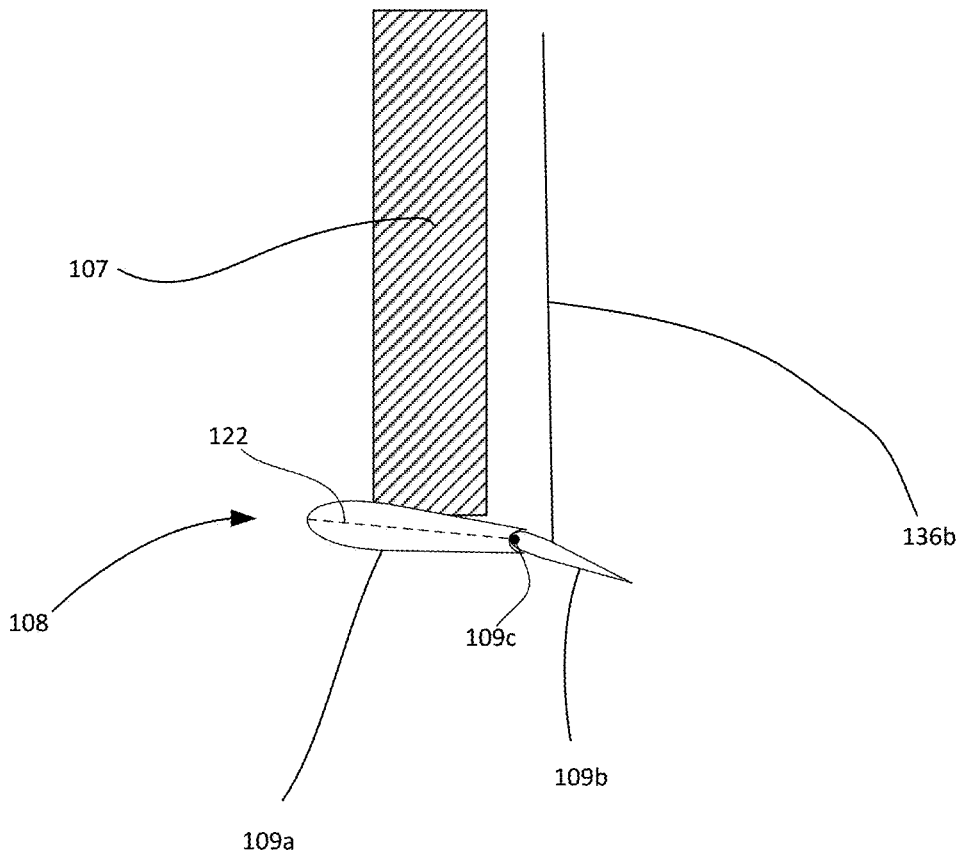
FIG. 4B is an expanded side view of a portion of the hydrofoiling sailing vessel shown in FIG. 4A.

The hydrofoil member 108 and can have a shape that, when the sailing vessel 100 moves forward through the water with the hydrofoil member 108 deployed in the water, generates hydrodynamic a lifting force having a component in a direction upward and perpendicular to the surface of the water in which the sailing vessel 100 moves. For example, the hydrofoil member 108 can have a curved cross section, when viewed from the transverse perspective shown in FIG. 3 and FIG. 4A, that is shaped and oriented to develop hydrodynamic lift when hydrofoil member 108 is deployed in the water and the vessel 100 moves through the water. FIG. 4B is an expanded side view of the hydrofoil member 108 shown in FIG. 4A.

The lifting force of the hydrofoil member 108 can be automatically controlled based on the height of the hulls 102 with respect to the surface of the water, so that when the hulls 102 are in the water or close to the water, the lifting force is relatively high and when the hulls are relatively high out of the water, the lifting force is relatively low. For example, the hydrofoil member 108 can include a forward-located fixed member 109*a* and a pivoting, or articulating, aft member (or flap element) 109*b*, whose forward portion pivots about a pivot position 109*c* located at the trailing portion of the forward member for fixed element) 109*a*. The angle between the longitudinal axes of the cross sections of the forward member 109*a* and of the aft member 109*b* can be changed to change the cross-sectional shape of the hydrofoil member 108 and thereby to change the lifting force provided by the hydrofoil member 108 for a given speed of the hydrofoil member 108 through the water. The angle can be controlled automatically, in response to the angle of a wand 130 that extends downward into, or onto, the water when the sailing vessel 100 is moving through the water and the hydrofoil member 108 is deployed in the water. The angle can be controlled automatically through a number of different control mechanisms, including, for example, through mechanical, electronic, pneumatic, etc. control mechanisms.

In one implementation, the wand 130 can be pivotably attached at a pivot point 134 to a structure 132 that is connected to, or integrated with, the vertical member 107 of the main hydrofoil structure 106, and the wand 130 can pivot about the pivot point 134 with respect to a vertical direction. The structure 132 can be, for example, an arm that extends forward from the vertical member 107, where the vertical member is connected to the hulls through the trunk member 104 that can be connected to the hulls through beams that are attached to the two hulls 102. A biasing torque can be applied to the wand pushing the wand toward into a vertical direction (e.g., clockwise about the pivot point 134 shown in FIG. 1). However, as the vessel 100 moves through the water and when the vertical member 107 of the hydrofoil structure 106 and the structure 132 attached to the hydrofoil structure 106 are lowered from their position shown in FIG. 1 (e.g., to positions shown in FIG. 3 or shown in FIG. 4A), such that the hydrofoil member 108 and at least a portion of the wand 130 extend into the water, the force of the moving water on the portion of the wand 130 that extends into the water can push the bottom of the wand aft, thereby applying a counterclockwise torque about the pivot point 134, and therefore increasing the angle of the wand 130 with the vertical direction. With the pivot point 134 in a fixed position with respect to the hulls 102, the angle of the wand 130 with respect to the vertical direction can be based at least in part on the height of the hulls above the water, which determines the portion of the wand 130 that is subject to force by the water as the vessel moves through the water and therefore the angle of the wand with respect to the vertical direction.

The angle of the wand 130 with respect to the vertical direction can be used to adjust and control a configuration of the hydrofoil member 108 as the hydrofoil member 108 moves through the water, where the configuration of the hydrofoil member 108 serves to control an amount of lifting force that is generated by the hydrofoil member 108. For example, in one implementation, the hydrofoil 108 can be biased in a cambered, high-lift, position, with the trailing edge of the aft member 109*b* being lower than the pivot position 109*c* between the front and aft members of the hydrofoil, and a control rope 136 (two parts of the rope 136 are indicated as 136*a* and 136*b* in the Figures) can be attached to the wand 130 and also to the aft member (i.e., "flap element") 109*b* of the hydrofoil member 108 to change the configuration of the hydrofoil from its cambered, high-lift position in response to the height of the hulls 102 above the water. For example, as the angle of the wand 130 with the vertical direction changes, tension can be applied to the rope 136, which can pull upward on the aft member 109*b* of the hydrofoil member 108 and pivot the aft member upward about the pivot position 109*c* to cause the angle of the aft member relative to the forward member to decrease, thereby straightening the cross-sectional shape of the hydrofoil member and reducing the lifting force generated by the hydrofoil member 108. In some implementations, the rope 136 can be replaced with a pair of pull rods 136*a*, 136*b* that are joined by a bell crank 138 that transmits the linear motion in a first direction of rod 136*a* to linear motion in a second direction of rod 136*b*.

In another implementation, the hydrofoil 108 can be biased in an uncambered or negatively-cambered, low-lift (or negative lift), position, with the trailing edge of the aft member 109*b* being at the same height or higher than the pivot position 109*c* between the front and aft members of the hydrofoil. A first push rod 136*a* can be attached to the wand 130 and to a bell crank 138, and a second push rod 136*b* can be attached to the bell crank 138 and the aft member (i.e., "flap element") 109*b* of the hydrofoil member 108 to change the configuration of the hydrofoil from its low-lift position in response to the height of the hulls 102 above the water. For example, with wand 130 being biased toward its vertical orientation, when the wand is pushed aft by moving water when the hulls are in the water or at a small distance from the surface of the water, tension can be applied to the push rod 136*a* between the wand 130 and the bell crank 138 to rotate the bell crank. Rotation of the bell crank 138 can cause the push rod 136*b* between the bell crank 138 and the aft section 109*b* of the hydrofoil 108 to push downward on the aft member 109*b* of the hydrofoil member 108 and to pivot the aft member downward about the pivot position 109*c* to cause the angle of the aft member relative to the forward member to increase, thereby curving the cross-sectional shape of the hydrofoil member into a relatively more cambered, high-lift position and increasing the lifting force generated by the hydrofoil member 108. Thus, when the hulls 102 are in the water or just above the surface of the water, the hydrofoil can be configured in a high-lift configuration. When the hulls 102 are higher out of the water, and the wand becomes more vertically oriented, the bell crank 138 is rotated less and less force is applied to the aft member 109*b*, so that the cross-sectional shape of the hydrofoil 108 becomes straighter and generates less lift. This feedback system can stabilize the height of the hulls above the water as the vessel 100 moves through the water.

When the force of the push rod 136*b* between the bell crank 138 and the aft member 109*b* is applied to the middle of the aft member (i.e., the middle of the member along the transverse length of the aft member in a direction perpendicular to the longitudinal axes of the hulls), because the shear modulus of the material of the aft member is not infinite, the middle portion of the aft member 109*b* can be pressed down more than the outer transverse tips of the aft member. Because of this, the camber of the aft member 109*b*, and the lifting force generated by the aft member, can be greater in the middle of the member that at its tips. By appropriately selecting materials for the aft member, dimensions of the aft member, and the force of the pushrod required to configure the hydrofoil 108 and its high-lift configuration, the high-lift configuration can be one in which the transverse tips of the aft member 109*b* provide little lift, or no lift, or negative lift, in the high-lift configuration of the hydrofoil 108, so that drag due to tip vortices is reduced.

In addition to the mechanical mechanisms for controlling the configuration of the main hydrofoil 108 described herein, electronic control mechanisms also are possible. For example, the height of the hulls 102 above the water can be sensed (e.g., by a mechanical control system, such as the wand system described above, by an ultrasonic transmitter and receiver located on the sailing vessel, by an altimeter, or by some other system) and an electronic height signal can be generated based on the sensed height. The height signal then can drive a motor that controls the configuration of the hydrofoil 108 and thereby controls the lifting force provided by the hydrofoil.

In addition to controlling the configuration of the main hydrofoil 108 to control the amount of the lift force generated by the hydrofoil 108, the angle of attack of the hydrofoil through the water (e.g., the angle between fore-and-aft axis of the forward member 109*a* of the main hydrofoil member 108 and a plane parallel to the surface of the water) also can be controlled to control the amount of lift generated by the hydrofoil. For example, in some implementations, the angle of attack can be varied by controlling the fore-and-aft location of the vertical member 107 at the top of the sleeve of the trunk structure 104, while the fore-and-aft location of the vertical member 107 at the bottom of the sleeve of the trunk structure 104 remains fixed. In some implementations, the angle of attack can be controlled in response to the height of the hulls above the water surface. In some implementations, control of the angle of attack can be independent of the height of the hulls above the water surface—for example, the angle of attack could be adjusted to suit various wind and/or sea state conditions, but would not be adjusted dynamically in response to the height of the hulls 102 above the water. In some implementations, the angle of attack of the rudder hydrofoil 111*b* can be controlled similarly. In some implementations, the angle of attack of the rudder hydrofoil 111*b* can be controlled by controlling the distance between the top of the gantry 150 and the stern of the hulls relative to the distance between the bottom of the gantry 150 and the stern of the hulls. By changing this relative distance the vertical orientation of the rudder 111 with respect to the vertical direction, and therefore the angle of attack of the rudder hydro foil 111*b*, can be changed.

In some implementations, the rudder 111 can include one or more transverse through-holes that can be aligned with corresponding through-holes in the cassette structure 100, and when the one or more holes of the rudder 111 are aligned with one or more holes in the cassette, a pin can be inserted through the aligned holes hold the rudder in position. The through-holes in the rudder can be located in a number of different positions along the length of the rudder, so that the rudder can be pinned in place in the cassette structure 110 in different positions corresponding to different depths of the rudder 111 in the water. In some implementations, the rudder 111 can be held in place by a line that can secure the rudder to the cassette structure. For example, a line can be secured to one side of the cassette structure on a first side of the rudder 111, then pass through a hole in the rudder or a fitting attached to the top of the rudder, and then can be secured to a second side of the cassette structure on a second side of the rudder 111. By setting the length of the line between the two securing points on the different sides of the cassette structure, a minimum depth of the rudder 111 in the water can be controlled. For example, a short distance between the two securing points will mandate that the rudder 111 cannot rise above a relatively deep depth, while a long distance between the two securing points will allow the rudder 111 to operate at a relatively shallow depth. A combination of different securing mechanisms is also possible. For example, a pin inserted through through-holes in the rudder 111 in the cassette structure 110 can be used to hold the rudder in place at particular depths (e.g. positions corresponding to relatively shallow depths), while a line attached to the two sides of the cassette structure 110 and the rudder 111 can be used to hold the rudder in position that relatively deep depths.

Similarly, the vertical member 107 the main hydrofoil structure 106 can include one or more transverse through-holes that can be aligned with corresponding through-holes in the trunk structure 104, and when the one or more holes of the vertical member 107 are aligned with one or more holes in the trunk structure 104, a pin can be inserted through the aligned holes to hold the vertical member 107 in position. The through-holes in the vertical member 107 can be located in a number of different positions along the length of the vertical member 107, so that the vertical member 107 can be pinned in place in the trunk structure 104 in different positions corresponding to different depths of the vertical member 107 in the water. In some implementations, the vertical member 107 can be held in place by a line that can secure the vertical member 107 to the trunk structure 104. For example, a line can be secured to one side of the trunk structure on a first side of the vertical member 107, then pass through a hole in the vertical member 107 or a fitting attached to the top of the vertical member 107, and then can be secured to a second side of the trunk structure 104 on a second side of the vertical member 107. By setting the length of the line between the two securing points on the different sides of the trunk structure, a minimum depth of the vertical member 107, and therefore the hydrofoil 108 in the water can be controlled. For example, a short distance between the two securing points will mandate that the hydrofoil 108 cannot rise above a relatively deep depth, while a long distance between the two securing points will allow the hydrofoil 108 to operate at a relatively shallow depth. A combination of different securing mechanisms is also possible.

These techniques of securing the vertical positions of the rudder 111 and the main hydrofoil structure 106, in combination with the upward lifting force of their hydrofoils 111*b*, 108 can facilitate navigation of the sailing vessel 100 and shallow water landing of the sailing vessel 100, for example, on a beach. For example, when the sailing vessel is navigated from deeper water into shallow water, for example, in preparation for landing the sailing vessel on a beach, an operator of the vessel 100 can simply release the pins, line, etc. that secure the rudder 111 and/or the main hydrofoil structure 106 at relatively deep positions with respect to the surface of the water, and then the hydrodynamic lifting force on the foil 111*b* or on the foil 108 while the sailing vessel 100 is moving through the water can lift the rudder 111 or main hydrofoil structure 106, respectively, to a desired shallower position. When secured in a down position by a line, an operator can release the line and play out the line to allow the foil 111*b* and/or 108 to rise to a desired depth.

Thus, a range of functions can be achieved in the sailing vessel 100 with the location of the mainfoil trunk 104 forward of the mast 140. For example, having the mainfoil trunk 104 between the hulls and above the waterline 162 of the sailing vessel 100, rather than being part of a hull, allows the hydrofoil 108 to be lifted above the surface of the water during normal functioning of the sailing vessel 104. In addition, by having the structure 132 that supports the wand 130 and the wand pivot point 134 attached to the vertical member 107 of the main hydrofoil structure 106, the configuration of the main hydrofoil 108 and therefore the lifting force generated by the hydrofoil, can be controlled even when the hydrofoil 108 is in position at different heights with respect to the waterline 162 of the vessel 100. Minor adjustments to the location of the wand 130 with respect to the pivot point 134 of the wand, e.g., as shown in FIGS. 3 and 4, based on the vertical location of the hydrofoil 108 with respect to the waterline 162 can be made.

Figure 5:
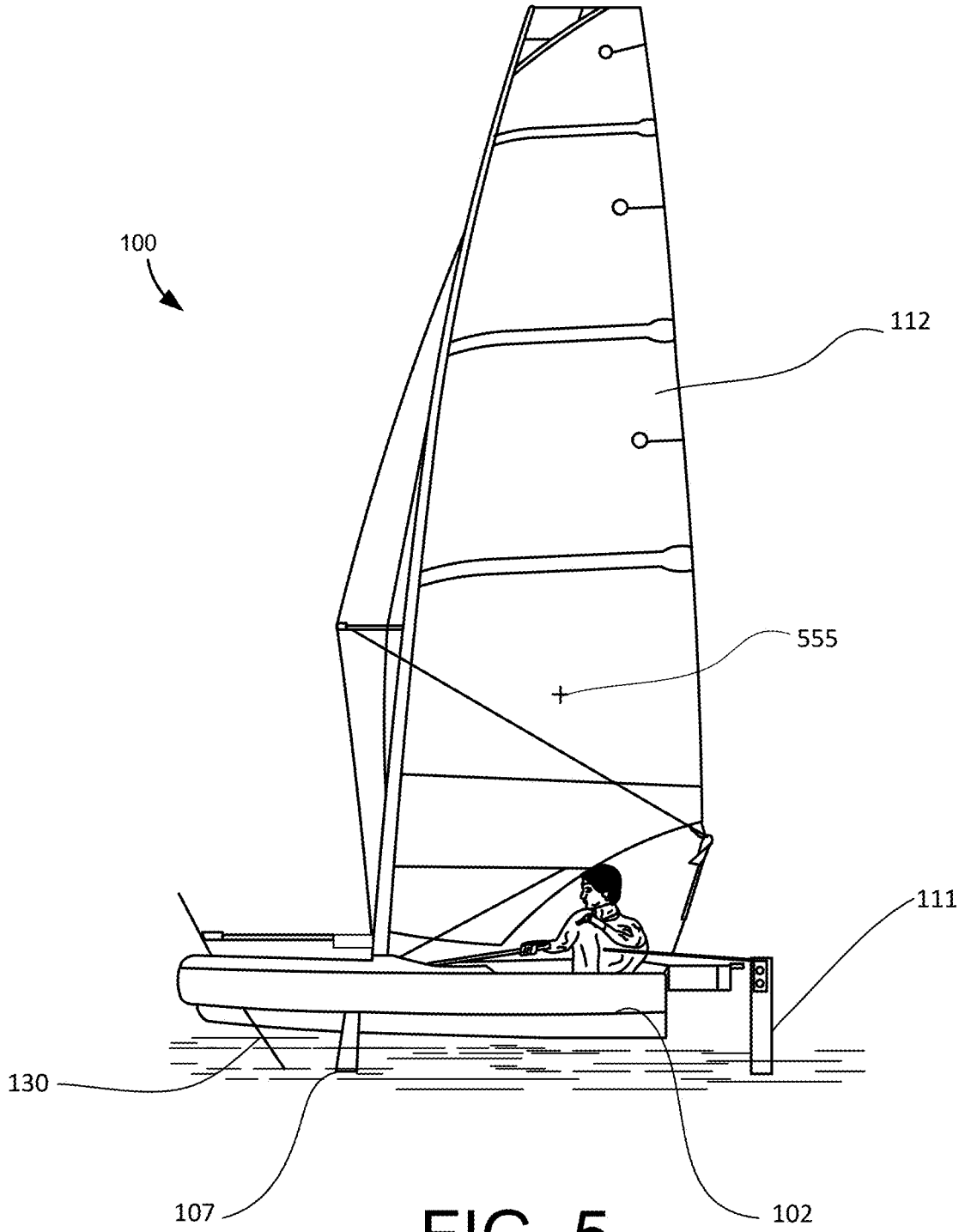
FIG. 5 is a side view of the hydrofoiling sailing vessel during operation of the vessel.

FIG. 5 is a side view of the sailing vessel 100 during operation of the vessel by a human crew. As shown in FIG. 5, vertical member 107 of the hydrofoil structure and the rudder 511 are inserted in the water, so that their respective hydrofoils are under the surface of the water and can generate lift as the sailing vessel 100 moves forward through the water. As shown in FIG. 5, the hulls 502 of the vessel 100 are fully out of the water, with the vessel moving forward through the water causing the hydrofoil member 108 of the main hydrofoil structure 106 and the second hydrofoil structure 111*b* of the rudder 111 to develop vertical forces that lift the hulls out of the water. In some implementations, the sailing vessel 100 can have a single mast and a single sail 112.

In some implementations, the sailing vessel 100 can be configured to be operated by a single person. For example, control mechanisms for controlling the sail 112 and the rudder 111 can be led to a location that is easily reachable by a single person. In some implementations, a length of the sailing vessel 100, from the stem of a hull to a stern of a hull can be less than a predetermined maximum length which can be, in some implementations, for example, 15 feet or less, 12 feet or less, or 10 feet or less. In some implementations, a weight of the sailing vessel 100 in its operational configuration, including the weight of, for example, the hulls 112, the rudder 111, the main foiling structure 106, the mast 140, the sail 112, etc., but without the weight of any human crew, can be less than a threshold weight, which can be in some implementations, for example, 170 pounds or less, 150 pounds or less, 130 pounds or less, or 110 pounds or less. 200 pound When the hydrofoil 108 is located far enough below the waterline so that the hulls 102 can be lifted out of the water, the hydrofoil 108 can be configured to generate a lifting force when the hulls move forward through water at a speed of less than seven meters per second that, when combined with lifting forces of other hydrofoils of sailing vessel (e.g., rudder hydrofoil 111*b*), is sufficient to lift both hulls 111*b* above the surface of the water, even with one human operator on board. For example, the hydrofoil 108 can be configured to generate a lifting force of greater than 200 pounds when the hulls move forward through water at a speed of seven meters per second.

Because the center of effort (CE) 555 of the sail 112 is so far behind the vertical member 107 of the main hydrofoil 106, the lateral surface area of the vertical member 111*a* of the rudder 111 that is in the water may be greater than the lateral surface area of the vertical member 107 that is in the water, so that the torque about the CE can be balanced between the torque due to the rudder vertical member 111*a* and the torque due to the vertical member 107 of the main hydrofoil structure 106.

Figure 6:
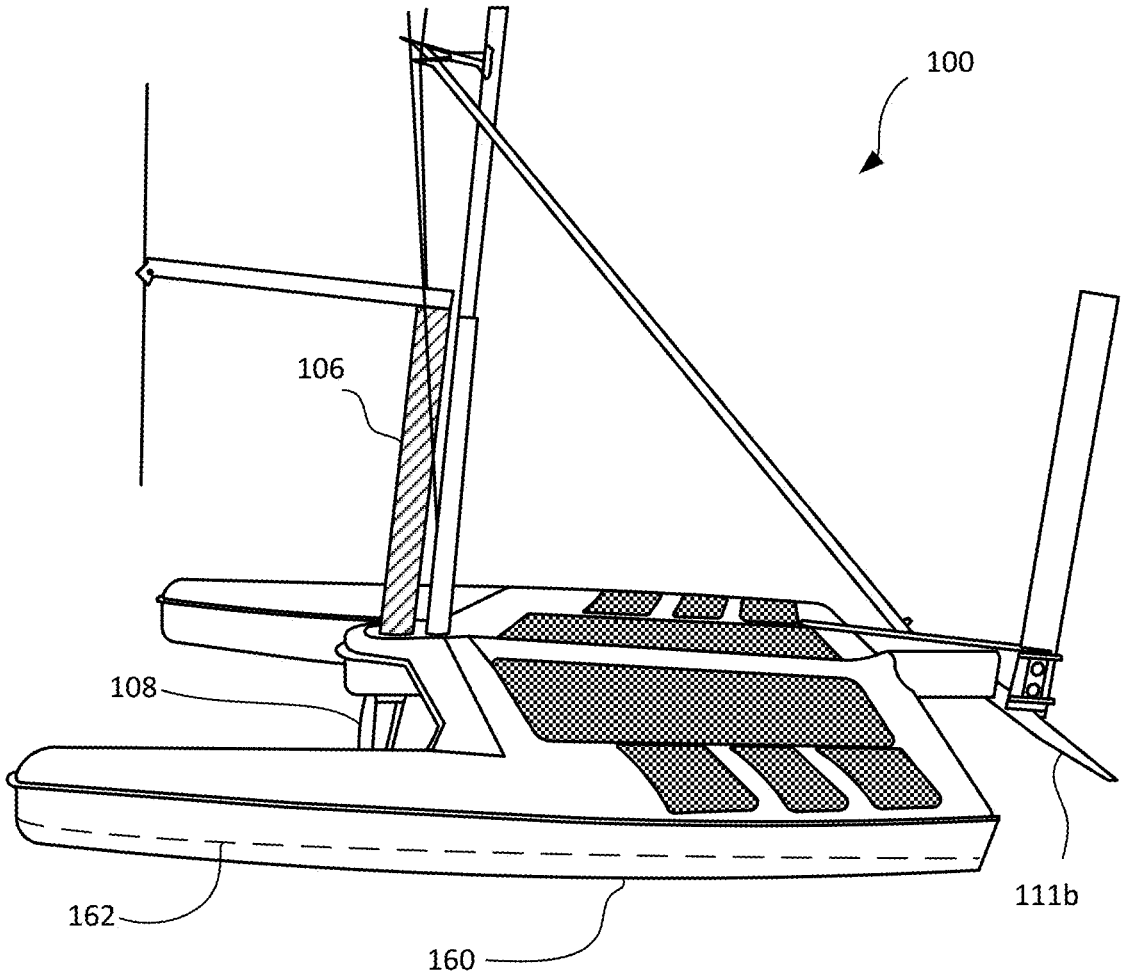
FIG. 6 is top perspective view of the hydrofoiling sailing vessel of FIG. 1.

FIG. 6 is a side perspective view of the sailing vessel 100 in its "launching state," in which the main hydrofoil 108 and the rudder hydrofoil 111*b* are retracted into their upward positions, such that the main hydrofoil 108 and the rudder hydrofoil 111*b* are above a plane that is parallel to the waterline 162 and that includes the bottoms 160 of the two hulls.

Figure 7:
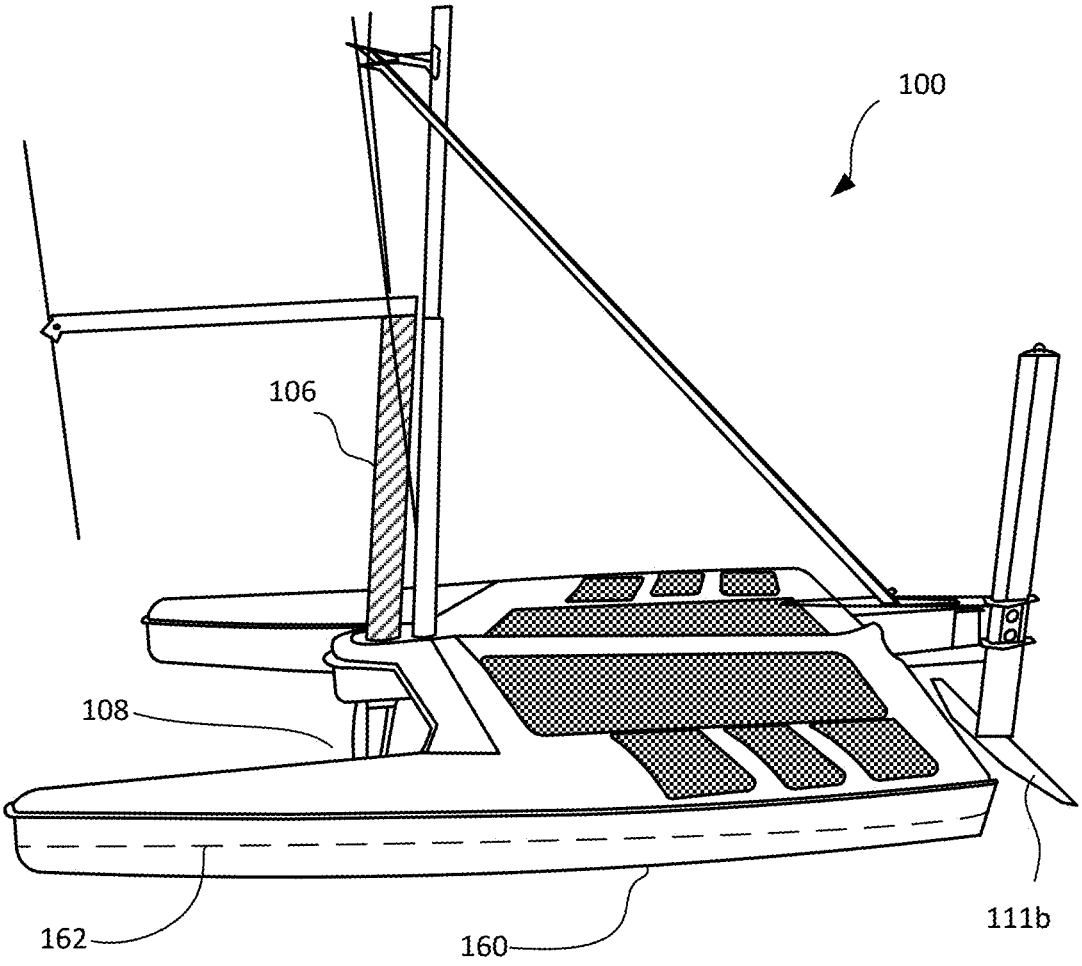
FIG. 7 is another perspective view of the hydrofoiling sailing vessel of FIG. 1.

FIG. 7 is a side perspective view of the sailing vessel in 100 its "non-foiling" navigation state in which the main hydrofoil member 108 of the main hydrofoil structure 106 is not deployed below the waterline 162 of the hulls 102, but the rudder hydrofoil member 111*b* and a small percentage of the rudder 111 are deployed below the waterline 162, to enable steering of the vessel 100.

Figure 8:
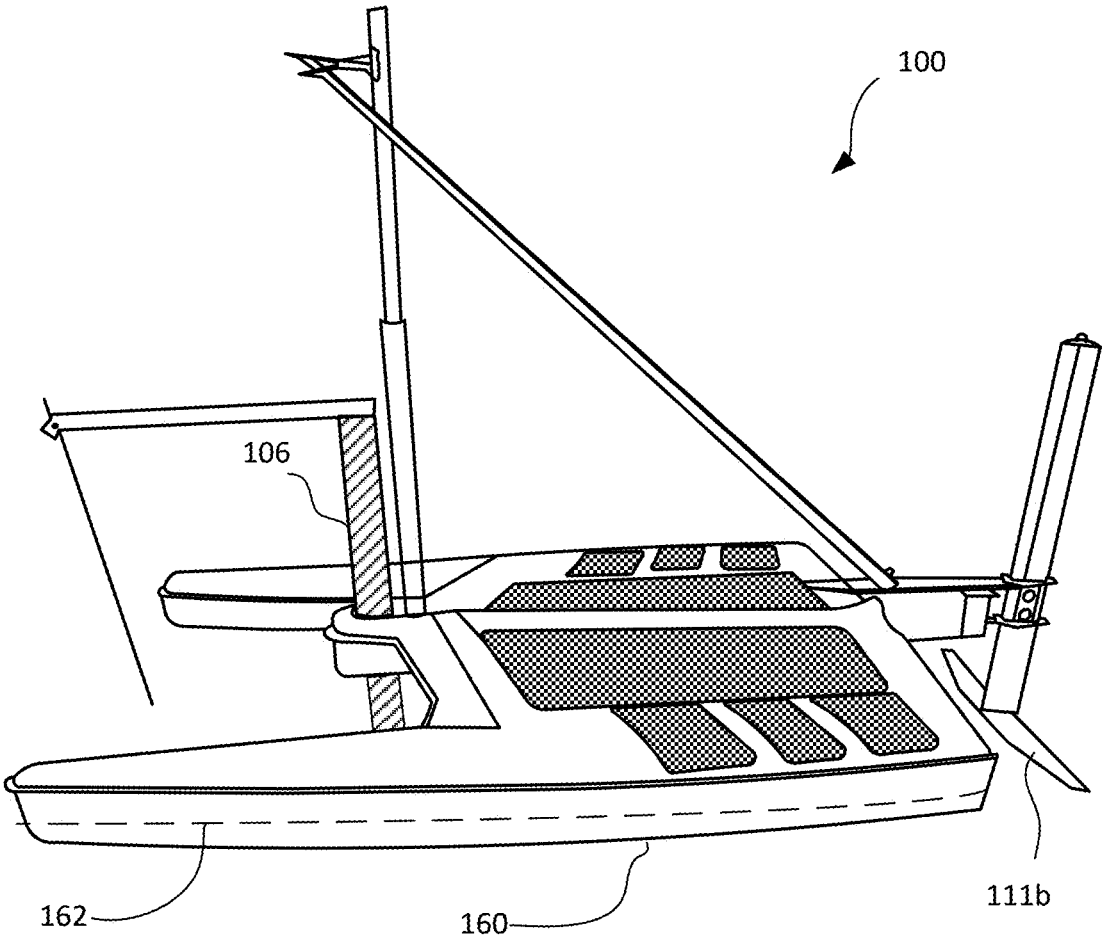
FIG. 8 is another top perspective view of the hydrofoiling sailing vessel of FIG. 1.

FIG. 8 is a side perspective view of the sailing vessel 100 in a third state, with the main hydrofoil member 108 of the main hydrofoil structure 106 and the rudder hydrofoil member 111*b* being partially deployed below the waterline 162 of the hulls 102 of the vessel 100.

Figure 9:
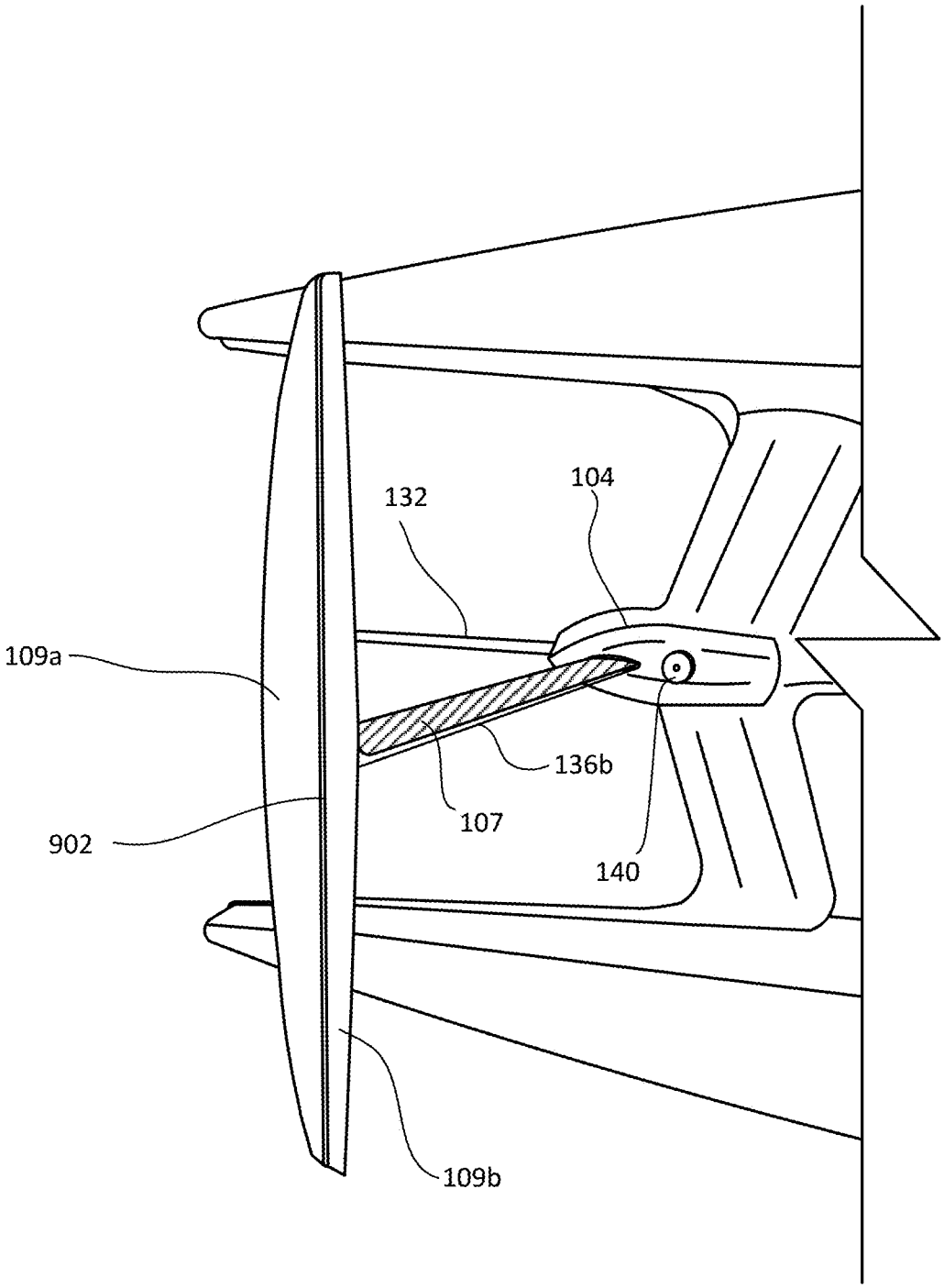
FIG. 9 is bottom perspective view of a portion of the hydrofoiling sailing vessel of FIG. 1.

FIG. 9 is a forward-looking, bottom perspective view of the sailing vessel 100, showing the main hydrofoil structure 106 in its fully deployed position, with the main hydrofoil member 108 at its lowest position relative to the 162 waterline of the hulls 102. Forward member 109*a* and aft members 109*b* of the hydrofoil member 108 are visible in FIG. 9, with the aft member 109*b* being capable of articulating about the joint 902 at which the forward and aft members connect, so as to control the amount of lifting force provided by the hydrofoil member 108. In addition, a pushrod 136*b* that provides automatic dynamic control of the angle between the forward member 109*a* and the aft member 109*b* is also visible. The trunk 104 through which the vertical member of the main lifting foil slides is also visible in FIG. 9. A bottom of mast 104 is visible, where the bottom of the mast 104 is mounted in a sleeve through the trunk structure 104 and is prevented from falling through the sleeve by an oversized collar above the sleeve, where the sleeve sits on the trunk structure that surrounds the sleeve.

Figure 10:
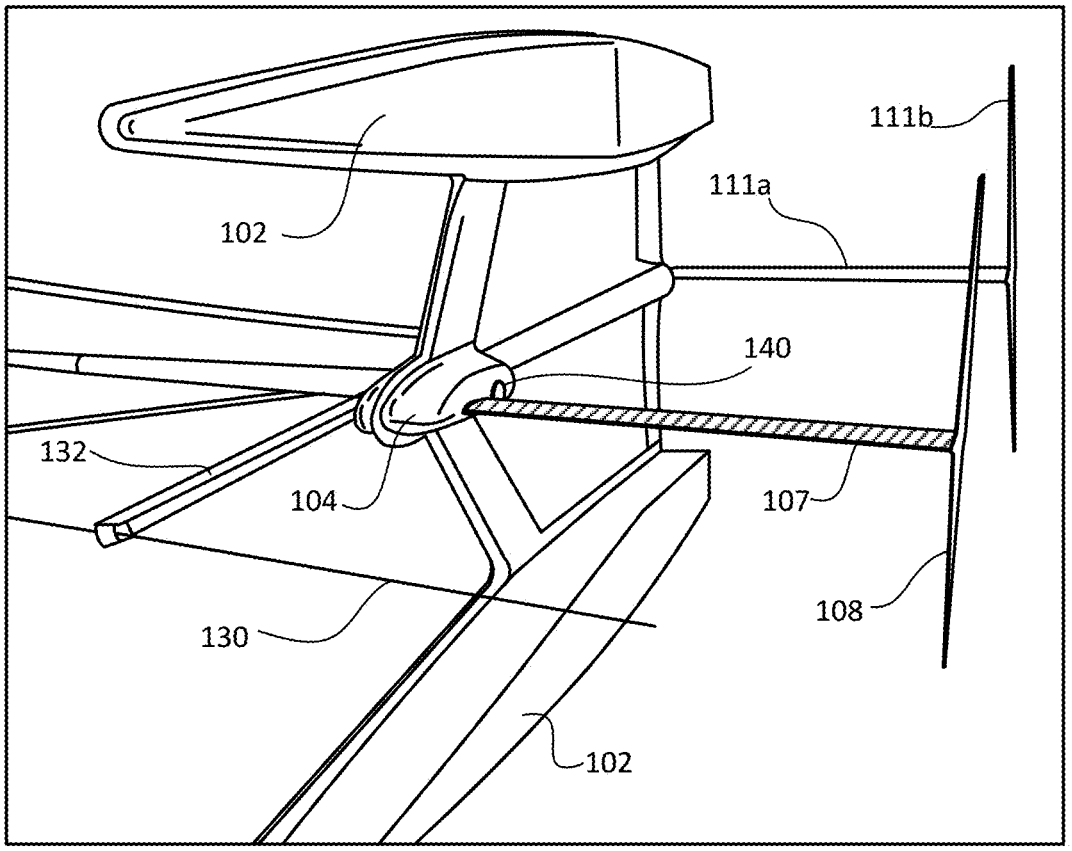
FIG. 10 is another bottom perspective view of a portion of the hydrofoiling sailing vessel of FIG. 1.

FIG. 10 is an aft-looking, perspective view of a bottom portion of the sailing vessel 100, showing the main hydrofoil structure 106, the rudder 111, and the rudder hydrofoil 111*a* in their fully deployed positions, with the main hydrofoil 108 and the rudder hydrofoil 111*a* at their lowest positions relative to the waterline of the hulls 102. In addition, the wand 130 that provides automatic dynamic control of the angle between the forward and aft lifting members is also visible. The trunk 104 through which the vertical member 107 of the main hydrofoil structure 106 slides is also visible in FIG. 10 in its location forward of the mast 140.

The vertical member 107 and the hydrofoil member 108 can be separately constructed to facilitate rigging of the sailing vessel. For example, the hydrofoil member 108 can include a short vertical section the extends vertically perpendicular to the hydrofoiling surface and that fits into a hollow sleeve of the vertical member 107. Then, the sailing vessel can easily be rigged by passing the vertical member through the sleeve of the trunk 104, inserting the vertical member of the hydrofoiling member 108 into its sleeve and securing the hydrofoiling member 108 to the vertical member (e.g., with a threaded rod that passes through the vertical member and that threads into a threaded female connector in the hydrofoil 108. With the trunk 104 being located above the bottom of the hulls, this can be done without tipping the sailing vessel 100 on its side.

Figure 11:
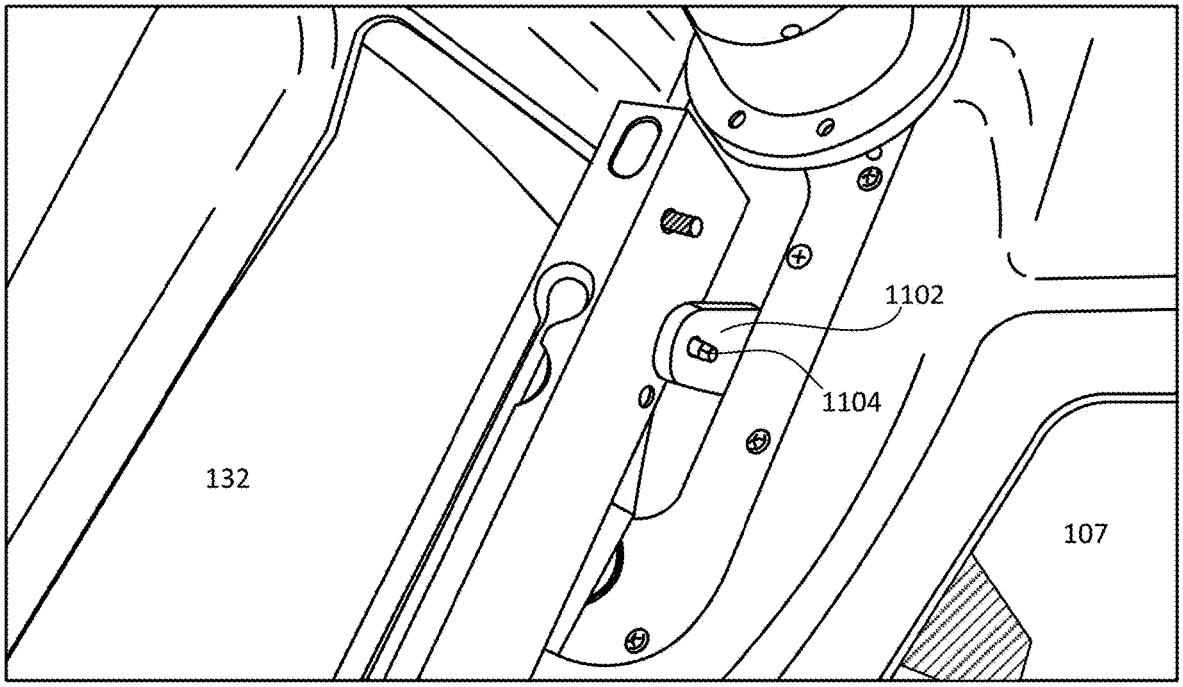
FIG. 11 is top perspective view of a portion of the hydrofoiling sailing vessel of FIG. 1.

FIG. 11 is a perspective view of a locking mechanism that secures the vertical member 107 of the main hydrofoil structure 106 in its lowest position relative to the waterline 162 of the hulls 102. A metal arm 132 can secured to the top of the vertical member 107 and to the wand 130. A metal bracket 1102 attached to the trunk has a hole in it, and a pin 1104 can be placed through the metal arm 132 and the hole of the bracket 1102 to secure the vertical member 107 of the main hydrofoil structure 106 in its lowest position relative to the waterline 162.

Figure 12:
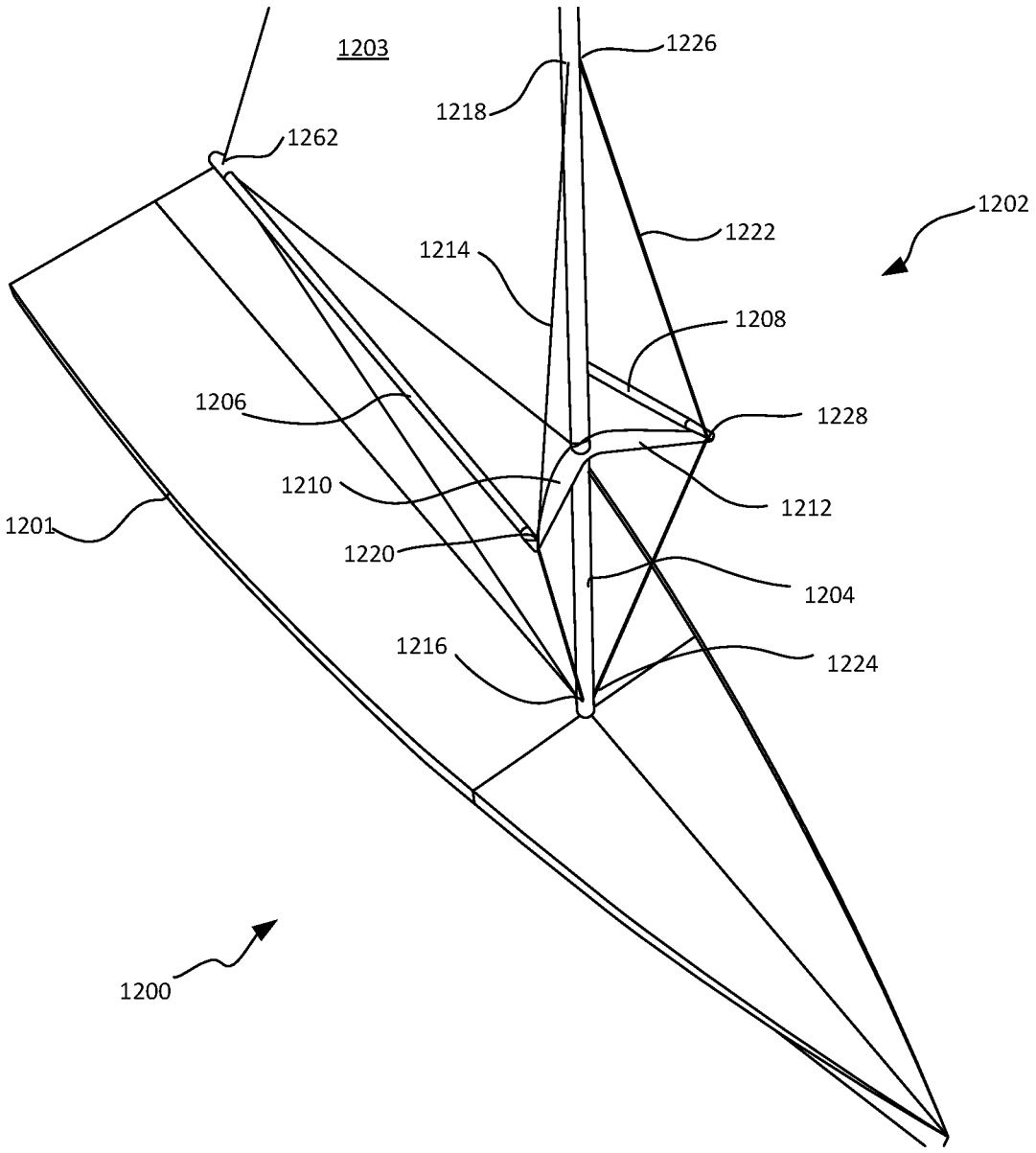
FIG. 12 is a top perspective view of a sailing vessel.

FIG. 12 is a top perspective view of a sailing vessel 1200 having at least one hull 1201 and a rig system 1202 for supporting a sail 1203 that propels the sailing vessel 1200. The sailing vessel can be a monohull, a catamaran, or a multihull sailing vessel. The rig system 1202 includes a mast 1204 and a wishbone boom system having a first boom member 1206 on a first side of the sail 1203 and a second boom member 1208 on a second side of the sail 1203. The sail 1203 is attached to the mast 1204 along on a luff of the sail.

The rig system 1202 additionally includes a first spreader member 1210 coupled to the mast and extending away from the mast 1204 and a second spreader member 1212 coupled to the mast and extending away from the mast. A first jumper stay 1214 is coupled to the mast at a first location 1216 below the first spreader member 1210 and at a second location 1218 above the first spreader member 1210. The first jumper stay 1214 is sprung away from the mast 1204 by an outboard end 1220 of the first spreader member 1210. A second jumper stay 1222 is coupled to the mast 1204 at a third location 1224 below the second spreader member 1212 and at a fourth location 1226 above the second spreader member 1212. The second jumper stay 1222 is sprung away from the mast 1204 by an outboard end 1228 of the second spreader member 1212.

The first boom member 1206 has a first end attached to the outboard end 1220 of the first spreader member 1210 and a second end that is located aft of the mast 1204. The second boom member 1208 has a first end attached to the outboard end 1228 of the second spreader member 1212 and a second end that is located aft of the mast 1204. The outboard ends 1220, 1228 of the first and second spreader members 1210, 1212 are located forward of the mast 1204. The second ends of the first and second boom members 1206, 1208 are coupled to each other and are configured to secure a clew of the sail 1203 when the sail is attached to the mast 1204. The second ends of the first and second boom members 1206, 1208 can be lower than the first ends of the boom members when the sailing vessel 1200 is operated.

The rig system 1202 can be used with a sail 1203 to allow the sail 1203 to operate efficiently in a range of when conditions. For example, when the sail 1203 has a nonnegative luff curve it can be difficult to raise the sail on a stiff straight mast 1204. With the use of the rig system 1202 a relatively bendy or soft mast can be used, so that the mast can be easily curved into conformity with the left curve of the sail 1203 when the sail is raised along the mast 1204 of the vessel 1200. However, the effective stiffness of the mast can be increased by tensioning the rig system 1202 after the sail 1203 has been raised on the mast 1204. For example, the jumper stays 1214, 1222 can be tensioned to increase the stiffness of the mast 1204. The tension of the jumper stays 1214, 1222 can be tensioned directly, for example, by pulling the jumper stays tighter to their securing points 1216, 1218, 1224, 1226. In addition, the jumper stays 1214, 1222 can be tensioned dynamically in response to the clew of the sail 1203 being pulled downward towards the hull 1201 of the sailing vessel 1200. By pulling the clew of the sail 1203 downward, the first and second boom members 1206, 1208 are pushed forward into the outer ends of the spreader members 1210, 1212 which spring the jumper stays 1214, 1222 away from the mast 1204, thereby tensioning the jumper stays 1214, 1222 and increasing the stiffness of the mast.

Figure 13:
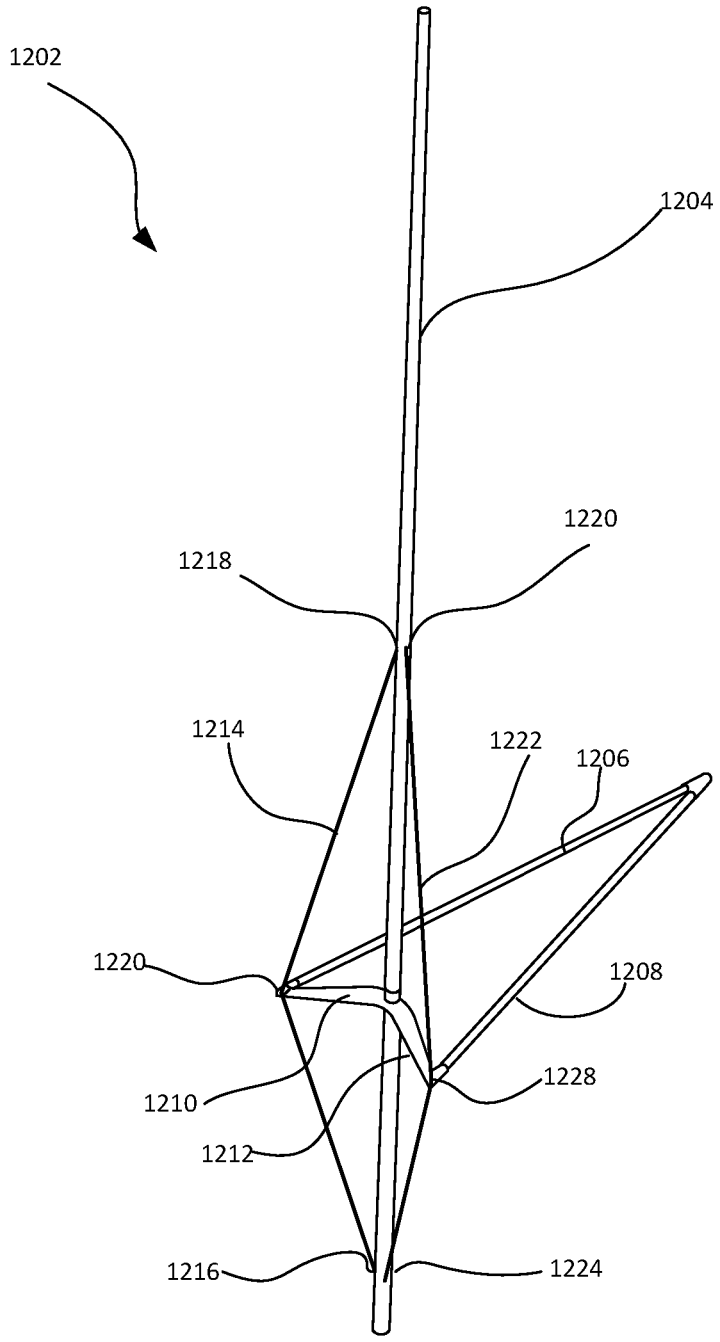
FIG. 13 is a perspective view of a rig system of a sailing vessel.

FIG. 13 is another perspective view of the rig system 1202 in which the sail 1203 and the hull 1201 of the sailing vessel 1200 are not shown.

Figure 14:
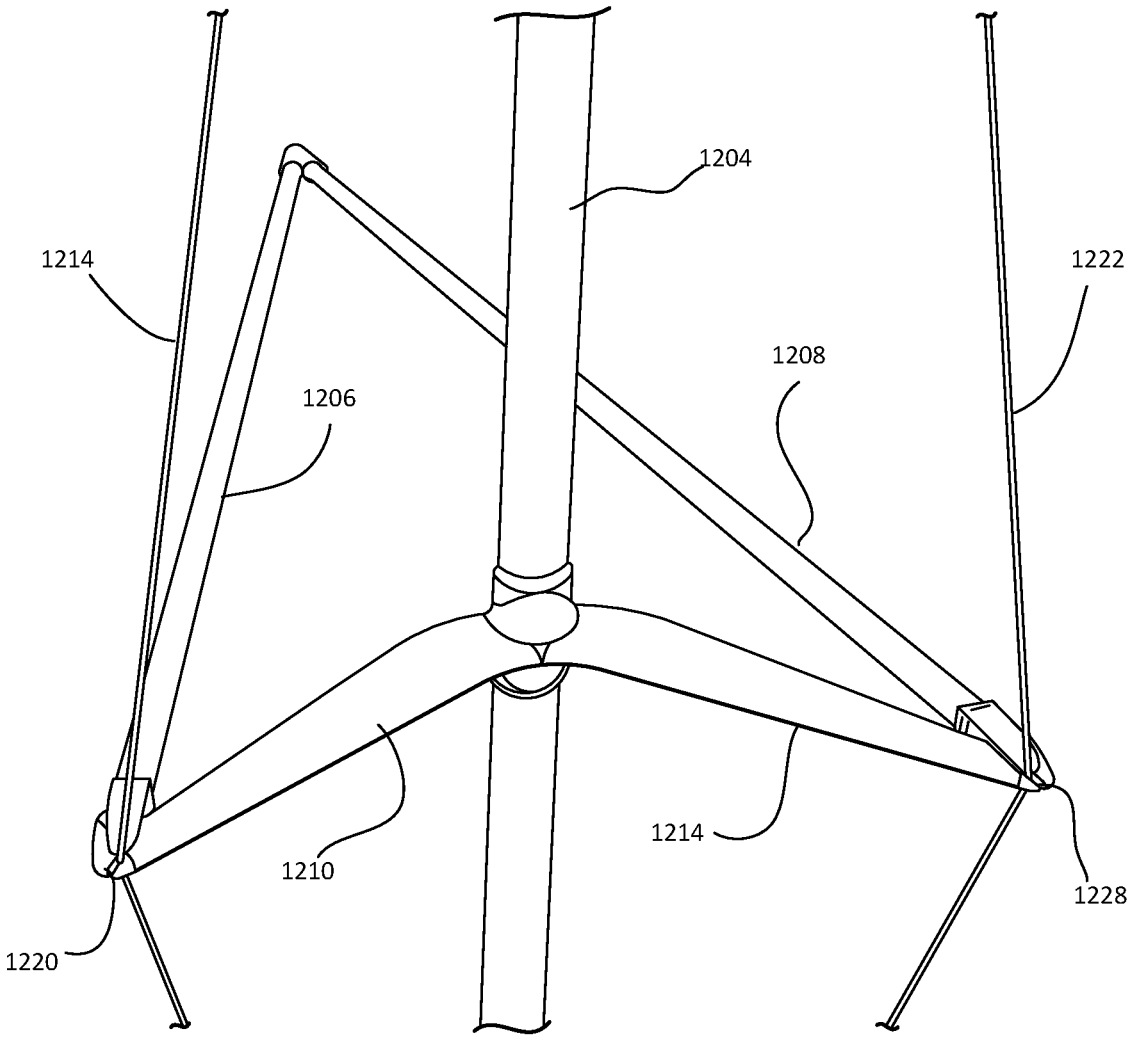
FIG. 14 is a detailed view of a portion the rig system.

FIG. 14 is a detailed view of the first and second spreader members 1210, 1214, the outboard ends of which 1220, 1228, respectively, are coupled to first ends of the first and second boom members 1206, 1208.

Figure 15:
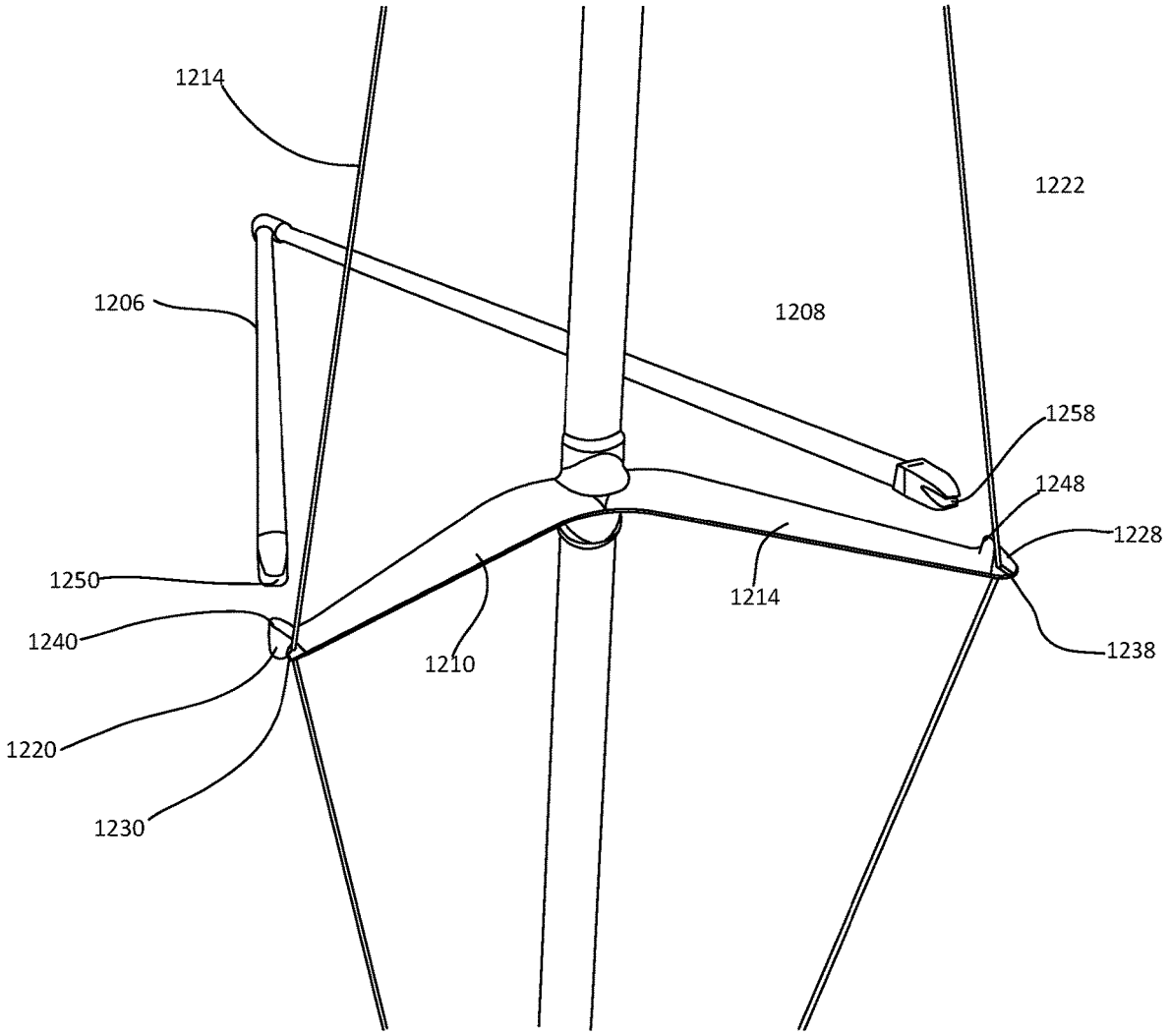
FIG. 15 is a detailed view of a portion the rig system.

FIG. 15 is a detailed view of the first and second spreader members 1210, 1214, the outboard ends of which 1220, 1228, respectively, can be coupled to first ends of the first and second boom members 1206, 1208. As shown in FIG. 15, the outboard ends 1220, 1228 of the spreader members 1210, 1214, respectively, include slots 1230, 1238 in which the jumper stays 1214, 1222, respectively, can be inserted to secure the jumper stays to the outer ends. The outer ends 1220, 1228 can include aft facing protrusions 1240, 1248 that can mate with recesses 1250, 1258 on the first ends of the boom members 1206, 1208 to couple the boom members to the outboard and of the spreader members.

Figure 16:
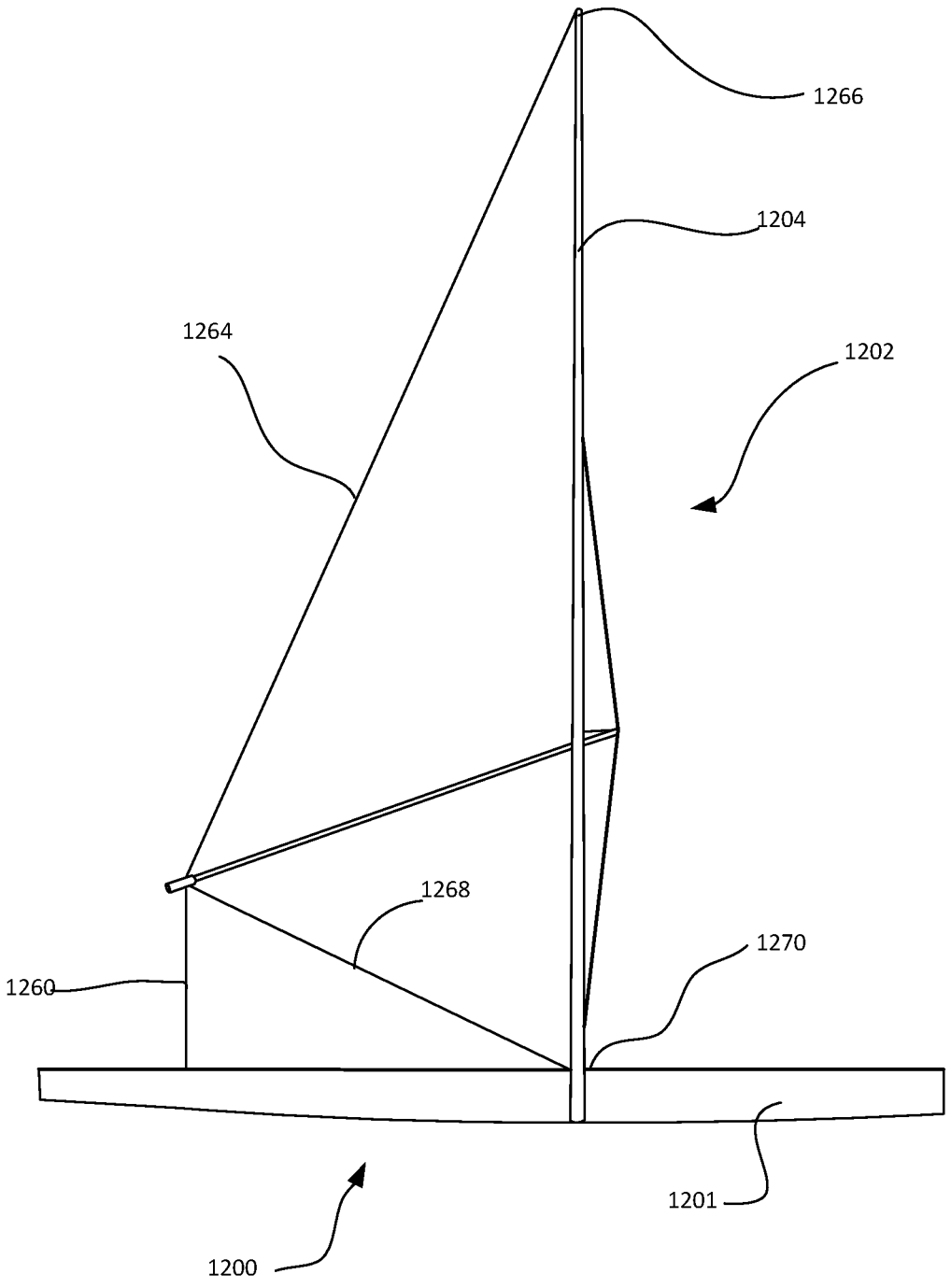
FIG. 16 is a schematic side view of the rig system

FIG. 16 is a schematic side view of the rig system 1202 for supporting a sail 1203 and attached to a hull 1201 of a sailing vessel 1200. A main sheet 1260 can be used to apply a variable amount of tension between a clew 1262 of the sail 1203 and the hull 1201. An operator of the sailing vessel 1200 can control the amount of tension applied to the main sheet 1260. A topping lift stay 1264 can be coupled to the second ends of the first and second members and also coupled to a tip 1266 of the mast 1204. A downhaul stay 1268 can be coupled to the ends of the first and second boom members 1206, 1208 and also to a base 1270 of the mast 1204. The tension of the downhaul stay 1268 and the tension of the topping lift stay 1264 can both be greater than 10 pounds during operation of the sailing vessel 1200. The tension of the downhual stay 1268 can be adjustable by an operator of the sailing vessel 1200.

During operation of the sailing vessel 1200 the tension applied to the first and second jumper stays 1214, 1222 can be greater than 10 pounds. The tension on the first and second jumper stays can be adjustable by an operator of the sailing vessel 1200. The second and fourth locations 1218, 1226 at which the first and second jumper stays 1214, 1222, respectively, are coupled to the mast 1204 can be between 30% and 70% of the way from a base of the mast that is stepped to a deck of the sailing vessel 1200 to the tip of the mast. The first and third locations: 16, 1224 at which the first and second jumper stays 1214, 1222, respectively are coupled to the mast 1204 can be between 0% and 20% of the way from the base of the mast to the tip of the mast. In this case, the second and fourth locations can be located on the mast between 50% and 75% away from a base of the mast to the tip of the mast. The first spreader member in the second spreader member can be rigidly attached to each other and can be integrated into a single uniform member.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A catamaran sailing vessel, comprising:

a first buoyant hull and a second buoyant hull, each buoyant hull extending along a longitudinal axis of the buoyant hull, the first and second buoyant hulls being connected to each other; and a first hydrofoil connected to the first and second buoyant hulls and oriented transverse to the buoyant hulls, wherein the first hydrofoil is movably coupled to the first and second buoyant hulls between a first position above a resting waterline of the buoyant hulls and a second position below a lowest extent of the buoyant hulls, wherein, when in the first position and when in the second position, the first hydrofoil is located entirely between a first vertical plane that contains the first buoyant hull and a second vertical plane that contains the second buoyant hull, and wherein, when the first hydrofoil is in the second position, a configuration of the first hydrofoil is adjustable to vary an amount of lifting force generated by the first hydrofoil when the buoyant hulls move forward through water when the first hydrofoil is in the second position.

2. The catamaran sailing vessel of claim 1, wherein the buoyant hulls are connected to each other by a beam member that extends in a direction transverse to the buoyant hulls, the beam member having ends that are attached, respectively, to the different buoyant hulls.

3. The catamaran sailing vessel of claim 1, wherein the configuration of the first hydrofoil is adjustable to vary a cross-sectional shape of the first hydrofoil.

4. The catamaran sailing vessel of claim 3, wherein the first hydrofoil includes a fixed element and a flap element connected to the fixed element, and wherein the cross-sectional shape of the first hydrofoil is varied by changing an angle of the flap element at a trailing edge of the first hydrofoil with respect to the fixed element of the first hydrofoil, wherein the fixed element is located forward of the flap element.

5. The catamaran sailing vessel of claim 3, wherein the configuration of the first hydrofoil further is adjustable to vary an angle of attack of the first hydrofoil with respect to the surface of the water.

6. The catamaran sailing vessel of claim 1, wherein the configuration of the first hydrofoil is adjustable automatically in response to a height of the buoyant hulls above the waterline of the buoyant hulls.

7. The catamaran sailing vessel of claim 1, further comprising:

a trunk connected to the buoyant hulls, the trunk including a vertical sleeve; and a daggerboard attached to the first hydrofoil;

wherein the daggerboard is movably mounted in the vertical sleeve, and wherein first hydrofoil is movable between the first position and the second position in response to vertical movement of the daggerboard within the sleeve.

8. The catamaran sailing vessel of claim 7, further comprising a rudder, wherein a lateral surface area of the rudder below the waterline is greater than a lateral surface area of the daggerboard below the waterline when the daggerboard is lowered to a downmost operational position of the daggerboard within the vertical sleeve.

9. The catamaran sailing vessel of claim 1, further comprising:

a rudder; and a second hydrofoil attached to the rudder and extending transversely from the rudder with respect to the longitudinal axes of the buoyant hulls.

10. The catamaran sailing vessel of claim 1, further comprising a mast, wherein the first hydrofoil is mounted forward of the mast.

11. The catamaran sailing vessel of claim 1, wherein when the first hydrofoil is in the second position the first hydrofoil is configured to generate a lifting force when the buoyant hulls move forward through water at a speed of less than seven meters per second, wherein the generated lifting force, when combined with lifting forces of other hydrofoils of sailing vessel, is sufficient to lift both buoyant hulls above the surface of the water.

12. The catamaran sailing vessel of claim 1, wherein when the first hydrofoil is in the second position, the first hydrofoil is configured to generate a lifting force of greater than 200 pounds when the buoyant hulls move forward through water at a speed of seven meters per second.

13. The catamaran sailing vessel of claim 1, further comprising:

a trunk connected to the buoyant hulls and located between the buoyant hulls, the trunk including a vertical sleeve; and a daggerboard attached to the first hydrofoil;

wherein the daggerboard is movably mounted in the vertical sleeve, and wherein first hydrofoil is movable between the first position and the second position in response to vertical movement of the daggerboard within the sleeve.

14. The catamaran sailing vessel of claim 13, further comprising a rudder, wherein a lateral surface area of the rudder below the waterline is greater than a lateral surface area of the daggerboard below the waterline when the daggerboard is lowered to a downmost operational position of the daggerboard within the vertical sleeve.

15. The catamaran sailing vessel of claim 1, further comprising:

a trunk connected to the buoyant hulls and located inboard of the buoyant hulls, the trunk including a vertical sleeve; and a daggerboard attached to the first hydrofoil;

wherein the daggerboard is movably mounted in the vertical sleeve, and wherein first hydrofoil is movable between the first position and the second position in response to vertical movement of the daggerboard within the sleeve.

16. The catamaran sailing vessel of claim 15, further comprising a rudder, wherein a lateral surface area of the rudder below the waterline is greater than a lateral surface area of the daggerboard below the waterline when the daggerboard is lowered to its downmost operational position within the vertical sleeve.

17. A sailing vessel comprising:

a hull;

a mast;

a first spreader member coupled to the mast and extending away from the mast;

a second spreader member coupled to the mast and extending away from the mast;

a first jumper stay being coupled to the mast at a first location below the first spreader member and at a second location above the first spreader member and being held at a distance away from the mast by an outboard end of the first spreader member, the outboard end of the first spreader member being located forward of the mast;

a second jumper stay being coupled to the mast at a third location below the second spreader member and at a fourth location above the second spreader member and being held at a distance away from the mast by an outboard end of the second spreader member, the outboard end of the second spreader member being located forward of the mast;

a wishbone boom including:

a first boom member having a first end attached to the first spreader member and a second end located aft of the mast; and a second boom member having a first end attached to the second spreader member and a second end located aft of the mast, wherein second ends of the first and second boom members are coupled to each other and are configured to secure an aft portion of a sail when the sail is attached to the mast.

18. The sailing vessel of claim 17, wherein a tension of the first jumper stay and a tension of the second jumper stay are greater than 10 pounds during operation of the sailing vessel.

19. The sailing vessel of claim 18, wherein the tension of the first and second jumper stays is adjustable by an operator of the sailing vessel.

20. The sailing vessel of claim 17, wherein the first location, the second location, the third location, and the fourth location are on the mast between 30% and 70% of the way from a base of the mast to the tip of the mast.

21. The sailing vessel of claim 17, wherein the first location and the third location are located on the mast between 0% and 20% of the way from a base of the mast to a tip of the mast and wherein the second location in the fourth location are located on the mast between 50% and 75% of the way from a base of the mast and a tip of the mast.

22. The sailing vessel of claim 17, wherein the first spreader member and the second spreader member are rigidly attached to each other.

23. The sailing vessel of claim 17, further comprising:

a topping lift stay being coupled to the second ends of the first and second boom members and being coupled to a tip of the mast; and a downhaul stay being coupled to the second ends of the first and second boom members and being coupled to a base of the mast.

24. The sailing vessel of claim 23, wherein a tension of the topping lift stay and a tension of the downhaul stay are both greater than 10 pounds during operation of the sailing vessel.

25. The sailing vessel of claim 24, wherein the tension of the downhaul stay is adjustable by an operator of the sailing vessel.

26. A multihull sailing vessel, comprising:

at least two buoyant hulls extending along a longitudinal axes of the buoyant hulls, the buoyant hulls being connected to each other;

a trunk connected to the buoyant hulls, the trunk including a vertical sleeve;

a first hydrofoil connected to the buoyant hulls and oriented transverse to the buoyant hulls; and a daggerboard attached to the first hydrofoil, wherein the daggerboard is movably mounted in the vertical sleeve, wherein first hydrofoil is movable between a first position above a resting waterline of the buoyant hulls and a second position below a lowest extent of the buoyant hulls in response to vertical movement of the daggerboard within the sleeve, and wherein, when the first hydrofoil is in the second position, a configuration of the first hydrofoil is adjustable to vary an amount of lifting force generated by the first hydrofoil when the buoyant hulls move forward through water when the first hydrofoil is in the second position.

27. The multihull sailing vessel of claim 26, wherein the buoyant hulls are connected to each other by a beam member that extends in a direction transverse to the buoyant hulls, the beam member having ends that are attached, respectively, to the different buoyant hulls.

28. The multihull sailing vessel of claim 26, wherein the configuration of the first hydrofoil is adjustable to vary a cross-sectional shape of the first hydrofoil.

29. The multihull sailing vessel of claim 28, wherein the first hydrofoil includes a fixed element and a flap element connected to the fixed element, and wherein the cross-sectional shape of the first hydrofoil is varied by changing an angle of the flap element at a trailing edge of the first hydrofoil with respect to the fixed element of the first hydrofoil, wherein the fixed element is located forward of the flap element.

30. The multihull sailing vessel of claim 28, wherein the configuration of the first hydrofoil further is adjustable to vary an angle of attack of the first hydrofoil with respect to the surface of the water.

31. The multihull sailing vessel of claim 26, wherein the configuration of the first hydrofoil is adjustable automatically in response to a height of the buoyant hulls above the waterline of the buoyant hulls.

32. The multihull sailing vessel of claim 26, further comprising a rudder, wherein a lateral surface area of the rudder below the waterline is greater than a lateral surface area of the daggerboard below the waterline when the daggerboard is lowered to a downmost operational position of the daggerboard within the vertical sleeve.

33. The multihull sailing vessel of claim 26, further comprising:

a rudder; and a second hydrofoil attached to the rudder and extending transversely from the rudder with respect to the longitudinal axes of the buoyant hulls.

34. The multihull sailing vessel of claim 26, further comprising a mast, wherein the first hydrofoil is mounted forward of the mast.

35. The multihull sailing vessel of claim 26, wherein when the first hydrofoil is in the second position the first hydrofoil is configured to generate a lifting force when the buoyant hulls move forward through water at a speed of less than seven meters per second, wherein the generated lifting force, when combined with lifting forces of other hydrofoils of sailing vessel, is sufficient to lift both buoyant hulls above the surface of the water.

36. The multihull sailing vessel of claim 26, wherein when the first hydrofoil is in the second position, the first hydrofoil is configured to generate a lifting force of greater than 200 pounds when the buoyant hulls move forward through water at a speed of seven meters per second.

37. The multihull sailing vessel of claim 26, wherein the sailing vessel is a catamaran sailing vessel having a first buoyant hull and a second buoyant hull, wherein the first hydrofoil is located entirely between a first vertical plane that contains the first buoyant hull and a second vertical plane that contains the second buoyant hull.

38. The multihull sailing vessel of claim 26, wherein the first hydrofoil is located inboard of each of the at least two buoyant hulls when in both the first position and the second position.

* * * * *